United States Patent [19]

Yagihara et al.

[11] Patent Number: 5,002,862

[45] Date of Patent: Mar. 26, 1991

[54] METHOD FOR PROCESSING A SILVER HALIDE COLOR PHOTOGRAPHIC MATERIAL WITH A COLOR DEVELOPER COMPRISING AN AROMATIC PRIMARY AMINE PRECURSOR

[75] Inventors: Morio Yagihara; Takatoshi Ishikawa; Hiroshi Fujimoto, all of Kanagawa, Japan

[73] Assignee: Fuji Photo Film Co., Japan

[21] Appl. No.: 250,280

[22] Filed: Sep. 28, 1988

[30] Foreign Application Priority Data

Sep. 28, 1987 [JP] Japan ..... 62-243463

[51] Int. Cl.[5] ..... G03C 7/30; G03C 7/00

[52] U.S. Cl. ..... 430/434; 430/443; 430/464; 430/467; 430/484; 430/490; 430/959

[58] Field of Search ..... 430/443, 434, 464, 467, 430/490, 959, 484

[56] References Cited

U.S. PATENT DOCUMENTS

| | | | |
|---|---|---|---|
| 4,157,915 | 6/1979 | Hamaoka et al. | 430/959 |
| 4,426,441 | 1/1984 | Adin et al. | 430/484 |
| 4,439,519 | 3/1984 | Ohki et al. | 430/959 |
| 4,473,635 | 9/1984 | Ishikawa et al. | 430/959 |
| 4,560,646 | 12/1985 | Long et al. | 430/443 |
| 4,684,604 | 8/1987 | Harder | 430/443 |
| 4,774,167 | 9/1988 | Koshimizu et al. | 430/380 |
| 4,798,783 | 1/1989 | Ishikawa et al. | 430/380 |
| 4,833,068 | 5/1989 | Ohki et al. | 430/380 |

OTHER PUBLICATIONS

Research Disclosure 13924, 11/75.
Research Disclosure 15159, 11/76.
Research Disclosure 12924, 11/74.

*Primary Examiner*—Paul R. Michl
*Assistant Examiner*—Patrick A. Doody

[57] ABSTRACT

A method for processing a silver halide color photographic material is described, comprising a support having thereon at least one light-sensitive silver halide emulsion layer, wherein after imagewise exposure, said silver halide color photographic material is processed with a color developer containing at least one aromatic primary amine developing agent and at least one compound capable of releasing the aromatic primary amine developing agent which has substantially no developing agent ability prior to the release of the aromatic primary amine developing agent.

13 Claims, No Drawings

METHOD FOR PROCESSING A SILVER HALIDE COLOR PHOTOGRAPHIC MATERIAL WITH A COLOR DEVELOPER COMPRISING AN AROMATIC PRIMARY AMINE PRECURSOR

FIELD OF THE INVENTION

The present invention concerns a method for processing a silver halide color photographic material and, particularly, it concerns a method for processing the photographic material, in which the stability and color forming property of the color developer are improved, and the increase in fogging which occurs during a continuous processing is remarkably reduced.

BACKGROUND OF THE INVENTION

Color developers containing aromatic primary amine developing agents have long been used for forming colored images, and they have played a central role in the formation of the colored images in color photographs. However, the above-mentioned color developers are very easily oxidized by air and metals. It is known that increased fogging and changes in sensitivity and gradation occur when a colored image is formed with an oxidized developer and it is impossible to achieve the desired photographic characteristics.

Hence, various means of increasing the preservation properties of color developers have been investigated in the past. Among these methods, a method in which hydroxylamine and sulfite ion are used in combination is most generally used. However, ammonia is formed when hydroxylamine breaks down and this causes fogging, and the sulfite ion acts competitively with the main developing agent and has the disadvantage of inhibiting color formation. Therefore, neither of these compounds can be said to be good preservatives.

Various other preservatives and chelating agents have been investigated in the past in an attempt to increase the stability of color developers. For example, the aromatic polyhydroxy compounds disclosed in JP-A-52-49828 (the term "JP-A" as used herein refers to a "published unexamined Japanese patent application"), JP-A-59-160142, JP-A-56-47038, and U.S. Pat. No. 3,746,544, the hydroxycarbonyl compounds disclosed in U.S. Pat. No. 3,615,503 and British Patent 1,306,176, the α-aminocarbonyl compounds disclosed in JP-A-52-143020 and JP-A53-89425, the alkanolamines disclosed in JP-A-54-3532 and the metal salts disclosed in JP-A-57-44148 and JP-A-5753749, etc., have been suggested as preservatives. Furthermore, the aminocarboxylic acids disclosed in JP-B48-30496 (the term "JP-B" as used herein refers to an "examined Japanese patent publication") and JP-B-4430232, the organic phosphonic acids disclosed in JP-A-5697347, JP-B-56-39359 and West German Patent 2,227,639, the phosphonocarboxylic acids disclosed in JP-A-52102726, JP-A-53-42730, JP-A-54-121127, JP-A-55-126241 and JP-A-55-65956, and the other compounds disclosed in JP-A58-195845, JP-A-58-203440 and JP-B-53-40900, etc., have proposed as chelating agents.

However, adequate preservation capacity cannot always be achieved using these techniques. Accordingly, there may be adverse effects on the photographic characteristics, and satisfactory results will not be obtained.

A deterioration in color forming properties is inevitable with color developers from which benzyl alcohol, a compound which is harmful in terms of pollution and preparation of solution, has been excluded. In such a system, the preservatives which act as competitive compounds inhibit color formation. Many of the techniques investigated in the past have proved unsatisfactory.

Moreover, color photographic materials which contain silver chlorobromide emulsions which have a high chlorine content are prone to fogging during color development, as described in JP-A-58-95345 and JP-A-59232342. Dissolution of the emulsion is slight in cases where emulsions of this type are used and preservatives which have a superior preserving capacity are essential. In this sense, no satisfactory preservative has yet been discovered.

SUMMARY OF THE INVENTION

Hence, one object of the present invention is to provide a method for processing a silver halide color photographic material in which the color developer has excellent stability.

Another object of the present invention is to provide a method for processing the photographic material which has excellent developing characteristics (for example, color forming properties).

A further object of the present invention is to provide a method for processing the photographic material in which the increase in the extent of fogging which occurs during continuous processing is remarkably reduced.

The above-mentioned objectives are realized by a method for processing a silver halide color photographic material comprising a support having thereon at least one light-sensitive silver halide emulsion layer, wherein after imagewise exposure, silver halide color photographic material is processed with a color developer containing at least one aromatic primary amine developing agent and at least one compound capable of releasing the aromatic primary amine developing agent which has substantially no developing agent ability prior to the release of the aromatic primary developing agent.

DETAILED DESCRIPTION OF THE INVENTION

The compound of the present invention (i.e., the compounds capable of releasing aromatic primary amine developing agents) are compounds from which aromatic primary amine developing agents are released or dissociated gradually under the conditions existing in a color developer. The developing agent may be released or dissociated as a result of the alkaline conditions or by means of some other component in the developer. Furthermore, the developing agent may be released by means of an oxidation reaction (for example, aerial oxidation).

The stability of the developer is greatly improved in the latter case and this is desirable.

The aromatic primary amine developing agent used in the color developer and the developing agent which is released may be the same or different.

Furthermore, the terminology "has substantially no developing agent ability" means that the compound has a developing agent ability of generally not more than one tenth, and preferably not more than one hundredth, of that of the aromatic primary amine developing agent with which the compound is used. That is, particularly preferably, the compound has not a developing agent ability at all.

Any compounds of the type described above can be used as the compound which is used in the present invention. However, preferred compounds are represented by formula (I) indicated below:

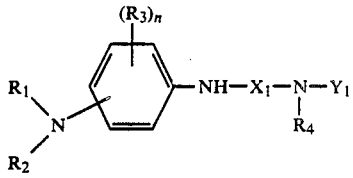

(I)

wherein $R_1$ and $R_2$ represent hydrogen atoms or alkyl groups, $R_3$ represents a group that can be substituted, $R_4$ represents a hydrogen atom, an alkyl group or an aryl group, $X_1$ represents a divalent group selected from —CO—, —$SO_2$—, —SO—,

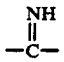

and —COCO—, and $Y_1$ represents an

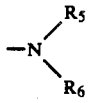

group or an —$OR_7$ group (wherein $R_5$ and $R_6$ represent hydrogen atoms, alkyl groups or aryl groups and $R_7$ represents a hydrogen atom or a group which can be hydrolyzed to become a hydrogen atom. $R_1$ and $R_2$, or $R_1$ and the benzene ring, or $R_2$ and the benzene ring, may be joined together to form a ring. Moreover, n has an integer of 0, 1, 2, 3 or 4.

The compounds represented by formula (I) are described in more detail below.

In formula (I), $R_1$ and $R_2$ represent hydrogen atoms or substituted or unsubstituted alkyl groups (preferably with from 1 to 10 carbon atoms, for example, methyl, ethyl, butyl, hexyl, isopropyl, cyclohexyl, benzyl, phenethyl). These may have, for example, as substituent groups, aryl groups, halogen atoms (for example, chlorine, bromine), hydroxyl groups, carboxyl groups, sulfo groups, amino groups, alkoxy groups, amide groups, sulfonamide groups, carbamoyl groups, sulfamoyl groups, aryloxy groups, alkylthio groups, arylthio groups, acyl groups, nitro groups, cyano groups, ureido groups, sulfonyl groups, sulfinyl groups, etc. In cases where there are two or more substituent groups, they may be the same or different. Moreover, the substituent groups may themselves be substituted. The preferred substituent groups are hydroxyl groups, alkoxy groups (for example, methoxy, ethoxy), alkylsulfonamide groups (for example, methanesulfonamino, ethylsulfonamino), halogen atoms (for example, chlorine, bromine), amide groups (for example, acylamino), amino groups (for example, unsubstituted amino, methylamino, dimethylamino).

$R_3$ represents a group that can be substituted. Representative examples of the group include halogen atoms (for example, fluorine, chlorine, bromine), alkyl groups (preferably those which have from 1 to 10 carbon atoms), aryl groups (preferably those which have from 6 to 10 carbon atoms), alkoxy groups (preferably those which have from 1 to 10 carbon atoms), aryloxy groups (preferably those which have from 6 to 10 carbon atoms) alkylthio groups (preferably those which have from 1 to 10 carbon atoms), arylthio groups (preferably those which have from 6 to 10 carbon atoms), acyloxy groups (preferably those which have from 2 to 10 carbon atoms), amino groups (preferably unsubstituted amino groups, or secondary or tertiary amino groups, etc., substituted with alkyl groups which have from 1 to 10 carbon atoms or aryl groups which have from 6 to 10 carbon atoms), carbonamide groups (preferably alkylcarbonamide groups which have from 1 to 10 carbon atoms and arylcarbonamide groups which have from 7 to 10 carbon atoms), ureido groups (preferably unsubstituted ureido groups, alkylureido groups which have from 2 to 10 carbon atoms or arylureido groups which have from 7 to 10 carbon atoms), carboxyl groups, carbonic ester groups (i.e., carbonate groups) (preferably alkylcarbonic acid esters which have from 2 to 10 carbon atoms or arylcarbonic acid esters which have from 7 to 10 carbon atoms), oxycarbonyl groups (preferably alkyloxycarbonyl groups which have from 2 to 10 carbon atoms or aryloxycarbonyl groups which have from 7 to 10 carbon atoms), carbamoyl groups (preferably unsubstituted carbamoyl groups, alkylcarbamoyl groups which have from 2 to 10 carbon atoms and arylcarbamoyl groups which have from 7 to 10 carbon atoms), acyl groups (preferably alkylcarbonyl groups which have from 2 to 10 carbon atoms or arylcarbonyl groups which have from 7 to 10 carbon atoms), sulfo groups, sulfonyl groups (preferably alkylsulfonyl groups which have from 1 to 10 carbon atoms or arylsulfonyl groups which have from 6 to 10 carbon atoms), sulfinyl groups (preferably alkylsulfinyl groups which have from 1 to 10 carbon atoms, arylsulfinyl groups which have from 6 to 10 carbon atoms), cyano groups, sulfamoyl groups (preferably unsubstituted sulfamoyl groups, alkylsulfamoyl groups which have from 2 to 10 carbon atoms or arylsulfamoyl groups which have from 6 to 10 carbon atoms), and nitro groups.

When there are two or more substituent groups these may be the same or different, and the substituent groups may themselves be substituted.

$R_4$ represents a hydrogen atom, a substituted or unsubstituted alkyl group (preferably one which has from 1 to 10 carbon atoms, for example, methyl, ethyl, butyl, hexyl, benzyl, phenethyl), or a substituted or unsubstituted aryl group (preferably one which has from 6 to 10 carbon atoms, for example, phenyl, naphthyl), and the substituent groups may be the same as substituent groups for $R_1$ and $R_2$ indicated above. When there are two or more substituent groups, these may be the same or different and, moreover, the substituent groups may themselves be substituted.

$X_1$ represents a divalent group selected from —CO—, —$SO_2$—, —SO—,

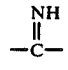

and —COCO—, and $Y_1$ represents

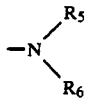

or —$OR_7$. $R_5$ and $R_6$ represent hydrogen atoms, substituted or unsubstituted alkyl groups, or substituted or unsubstituted aryl groups. The alkyl groups, aryl groups and their substituent groups are the same as those indicated for $R_4$, and when there are two or more substituent groups, they may be the same or different The substituent groups may also themselves be substituted. $R_7$ represents a hydrogen atom or a group which may be hydrolyzed to become a hydrogen atom. Representative examples of $R_7$ include:

(1) Cases in which protection is provided by an ester bond or a urethane bond. That is, where $R_7$ represents a

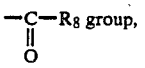

and group $R_8$ can be a substituted or unsubstituted alkyl group, a substituted or unsubstituted aryl group, or a substituted or unsubstituted amino group.

(2) Cases in which protection is provided by an imidomethine blocking group, as disclosed in JP-A-57-158638.

That is, where $R_7$ is represented by

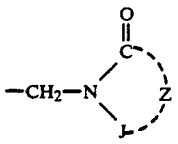

wherein

J represents

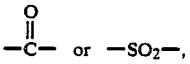

and Z represents a plurality of atoms which is required to complete a heterocyclic ring which has at least one 5- or 6-membered ring.

Furthermore, $R_1$ and $R_2$, $R_1$ and the benzene ring, or $R_2$ and the benzene ring, may be joined together to form a ring (for example, the ring formed by joining together of $R_1$ and $R_2$ may be a piperidine ring, a pyrrolidine ring, a morpholine ring, etc., and the ring formed from $R_1$ and the benzene ring, or $R_2$ and the benzene ring, may be, for example, an indoline ring, a tetrahydroquinoline ring, etc.).

n has an integer of 0, 1, 2, 3 or 4.

$R_1$ and $R_2$ in formula (I) are preferably substituted or unsubstituted alkyl groups, $R_3$ is preferably an alkyl group (for example, methyl, ethyl), an alkoxy group (for example, methoxy, ethoxy, methoxyethoxy), a halogen atom (for example, chlorine, bromine), or an alkylthio group (for example, methylthio, ethylthio), and $R_4$ is preferably a hydrogen atom. Moreover, $X_1$ is preferably a —CO— group or a —COCO— group, $Y_1$ is an —$NHR_5$ group or an —OH group, and n is preferably an integer of 0 or 1.

Among compounds represented by formula (I), compounds represented by formula (II) are particularly preferable.

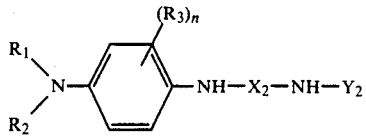

(II)

wherein $R_1$, $R_2$, $R_3$ and n have the same meaning as in formula (I). n is preferably 1, and in this case, $R_3$ is preferably substituted at a position ortho to the —$NHX_2NHY_2$ group which is substituted onto the benzene ring, being, most desirably, an alkyl group or an alkoxy group (which preferably has from 1 to 5 carbon atoms). $R_1$ and $R_2$ are preferably substituted or unsubstituted alkyl groups (which preferably have from 1 to 5 carbon atoms). $X_2$ represents a divalent group, either a —CO—group or a —COCO— group, and $Y_2$ represents either an —$NHR_5$ group or an —OH group ($R_5$ has the same meaning as in formula (I), i.e., preferably a hydrogen atom or a substituted or unsubstituted alkyl group and, most desirably, a hydrogen atom).

The compounds of the present invention not only increase the stability of the developer but also release aromatic primary amine developing agents as they dissociate in the developer. Therefore, the reduction of the amount of developing agent in the developer is minimal and it is possible to achieve stabilization of the developer to a degree which has not possible in the past.

Representative examples of the compounds represented by formula (I) are indicated below, but the present invention is not to be construed as being limited by these examples.

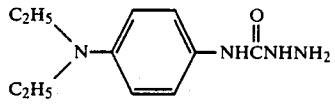

(I-1)

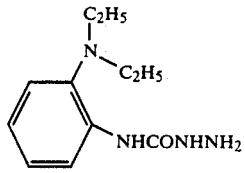

(I-2)

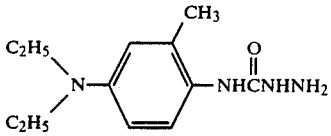

(I-3)

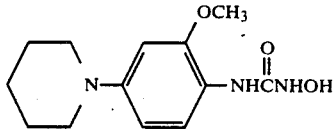

(I-4)

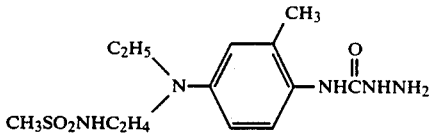

(I-5)

-continued
(I-6)
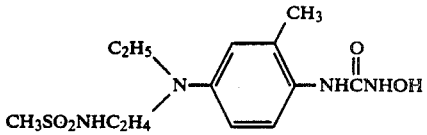
(I-7)
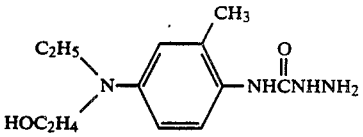
(I-8)
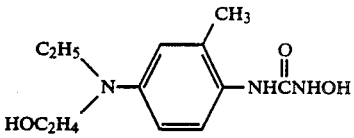
(I-9)
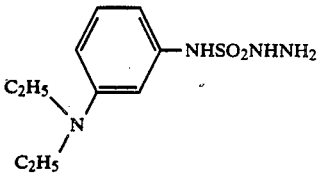
(I-10)
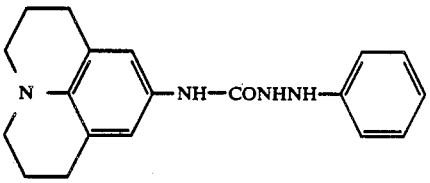
(I-11)
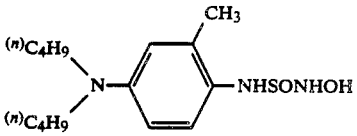
(I-12)
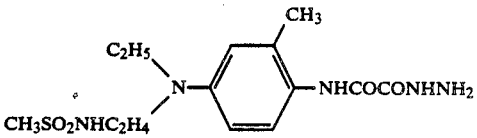
(I-13)
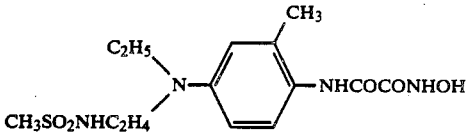
(I-14)
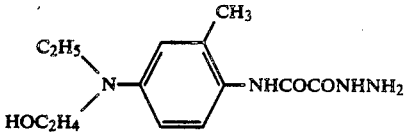
(I-15)
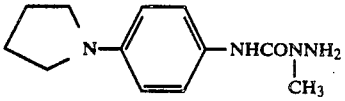
-continued
(I-16)
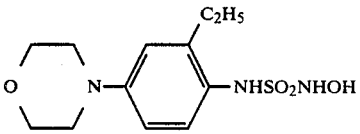
(I-17)
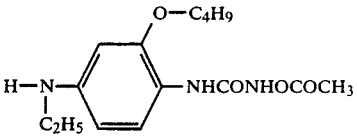
(I-18)
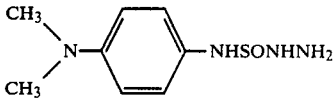
(I-19)
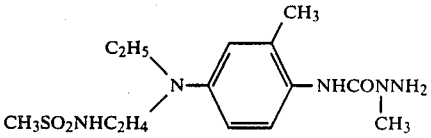
(I-20)
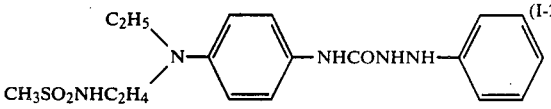
(I-21)
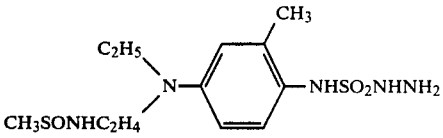
(I-22)
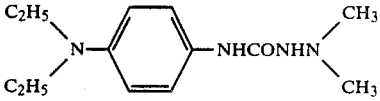
(I-23)
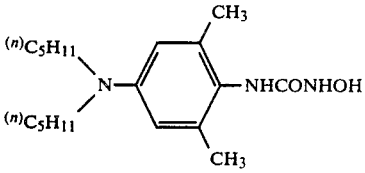
(I-24)
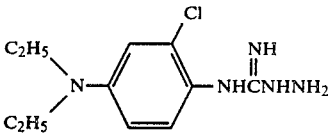
(I-25)
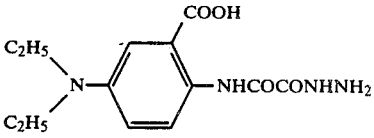
(I-26)
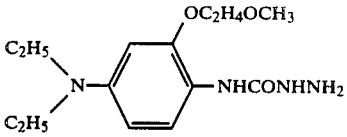

-continued

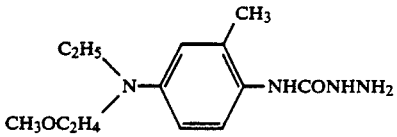

(I-27)

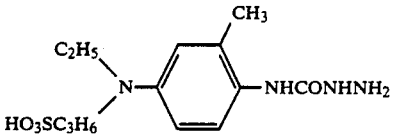

(I-28)

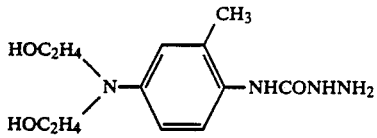

(I-29)

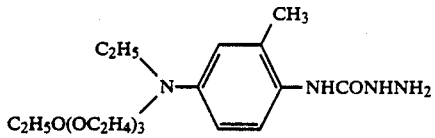

(I-30)

The compounds represented by formula (I) can be synthesized using the methods described in "Organic Functional Group Preparation", Vol. II, pp. 213 to 232; "Organic Synthesis", Coll. Vol. I, p. 450; by F. J. Wilson and E. C. Pickering in *J. Chem. Soc.*, 123, 349 (1923) and by N. J. Leonord and J. H. Boyer in *J. Orq. Chem.*, 15, 42 (1950).

Representative examples of the synthesis of typical compounds of the present invention are described below.

SYNTHESIS EXAMPLE I

Illustrative Compound (I-5)

2-Methyl-4-[N-ethyl-N-(β-methanesulfonamidoethyl)amino]aniline sulfate (87 g, 0.2 mol) and 50 ml of pyridine were added to 200 ml of acetonitrile and then 26.5 ml (0.2 mol) of phenyl chloroformate was added dropwise with ice cooling. The mixture was then stirred for a period of 5 hours at room temperature, after which 200 ml of water and 200 ml of ethyl acetate were added and the mixture was separated. The ethyl acetate phase was washed with water and then dried over sodium sulfate, after which the solvent was removed by distillation under reduced pressure and 37.6 g of 2-phenoxycarbonylamino-5- o [N-ethyl-N-(β-methanesulfonamidoethyl)amino]toluene (urethane compound) was obtained as an oily material. Next, 11.3 g (0.03 mol) of the urethane compound was added at room temperature to a solution consisting of 20 ml of water, 20 ml of isopropyl alcohol and 9.3 g (0.15 mol) of hydrazine hydrate (80%) and the mixture was stirred for a period of 5 hours whereupon white crystals were precipitated out.

These crystals were recovered by filtration and recrystallized from ethanol, whereupon 5.3 g of the target compound was obtained (yield: 53%). Melting Point: 160–162° C.

SYNTHESIS EXAMPLE II

Illustrative Compound (I-6)

Sodium bicarbonate (12.8 g, 0.15 mol) was added, in the presence of nitrogen gas, to a solution consisting of 20 ml of water, 20 ml of methanol and 10.35 g (0.15 mol) of hydroxylamine hydrochloride, after which 11.3 g (0.03 mol) of the urethane compound obtained in Synthesis Example I was added. The solution was heated to 50° C for a period of about 5 hours and then white crystals were precipitated out. These crystals were recrystallized from ethanol, whereupon 3.2 g of the target compound was obtained (yield: 32.3%). Melting Point: 174–175° C.

The amounts of the compounds represented by formula (I) to be added to the developer are generally within the range of from 0.01 to 20 g, and preferably within the range of from 0.5 to 10 g, per liter of the color developer.

In a system in which an aromatic primary amine color developing agent is being used, a compound represented by formulae (VII) to (XVI) indicated below is preferably used conjointly with a compound of the present invention as a compound which stabilizes a compound which directly stabilizes the developing agent.

The compounds represented by formulae (VII) to (XVI) are contained in the developer in an amount of preferably from 5 to 500 mmol/liter and more preferably from 20 to 200 mmol/liter (milli-mol/liter per the developer.

The compounds represented by formulae (VII) to (XVI) are shown below.

Specific examples of preferred monoamines are those represented by formula (VII):

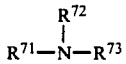

(VII)

wherein $R^{71}$, $R^{72}$ and $R^{73}$ each represents a hydrogen atom, an alkyl group, an alkenyl group, an aryl group, an aralkyl group, or a heterocyclic group. $R^{71}$ and $R^{72}$, $R^{71}$ and $R^{73}$, or $R^{72}$ and $R^{73}$ may combine with each other to form a nitrogen-containing heterocyclic ring. Preferably, the carbon atom number for $R^{71}$, $R^{72}$ and $R^{73}$ is from 1 to 10.

The groups represented by $R^{71}$, $R^{72}$ and $R^{73}$ may be substituted. Tho preferred substituents for $R^{71}$, $R^{72}$ and $R^{73}$ include an —OH group, a —COOH group, an —$SO_3H$ group, etc. $R^{71}$, $R^{72}$ and $R^{73}$ are particularly preferably a hydrogen atom or an alkyl group.

Specific examples of the compounds represented by formula (VII) are illustrated below.

$N(CH_2CH_2OH)_3$ VII-1

$H_2NCH_2CH_2OH$ VII-2

$HN(CH_2CH_2OH)_2$ VII-3

$C_7H_{15}N(CH_2CH(OH)CH_2OH)_2$ VII-4

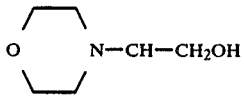

VII-5

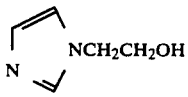

VII-6

-continued

VII-7

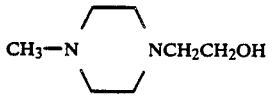

VII-8

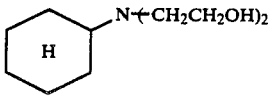

VII-9

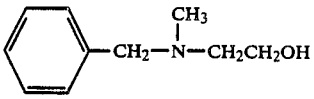

VII-10 $(HOCH_2CH_2)_2NCH_2CH_2SO_2CH_3$

VII-11 $HN(CH_2COOH)_2$

VII-12 $HOOCCH_2CH_2CH(NH_2)COOH$

VII-13 $H_2NCH_2CH_2SO_2NH_2$

VII-14 $H_2N-C(CH_2OH)_3$

VII-15 $HOCH_2CH(NH_2)COOH$

VII-16

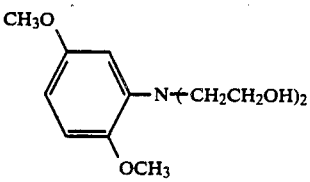

VII-17

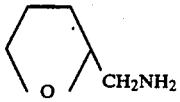

VII-18

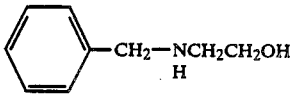

VII-19

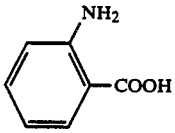

VII-20

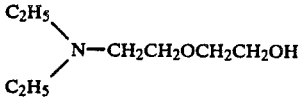

Examples of preferred diamines are those represented by formula (VIII):

(VIII)

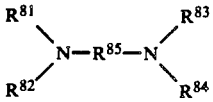

wherein $R^{81}$, $R^{82}$, $R^{83}$ and $R^{84}$ each represents a hydrogen atom, an alkyl group, an alkenyl group, an aryl group, an aralkyl group, or a heterocyclic group (preferably, the carbon atom number for $R^{81}$, $R^{82}$, $R^{83}$ and $R^{84}$ is from 1 to 10); and $R^{85}$ represents a divalent organic group such as an alkylene group, an arylene group, an aralkylene group, an alkenylene group, or a heterocyclic group (preferably, the carbon atom number for $R^{85}$ is from 1 to 10).

$R^{81}$, $R^{82}$, $R^{83}$, $R^{84}$ and $R^{85}$ may have substituents such as an —OH group, a —COOH group, an $—SO_3H$ group, etc.

$R^{81}$, $R^{82}$, $R^{83}$ and $R^{84}$ are preferably a hydrogen atom or an alkyl group and $R^{85}$ is preferably an alkylene group.

Specific examples of the compound represented by formula (VIII) are illustrated below.

VIII-1

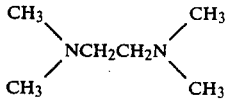

(VIII-2) $(HOCH_2CH_2)_2NCH_2CH_2N(CH_2CH_2OH)_2$

VIII-3

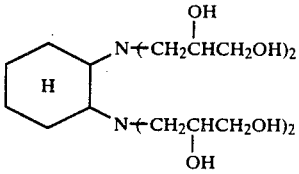

VIII-4 $H_2NCH_2CH_2N(CH_2CH_2OH)_2$

VII-5 $H_2NCH_2CH(OH)CH_2NH_2$

VIII-6

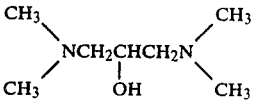

VIII-7

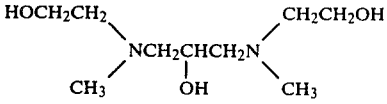

VIII-8

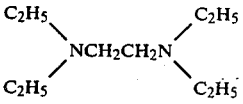

VIII-9

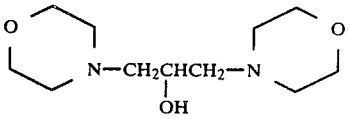

VIII-10

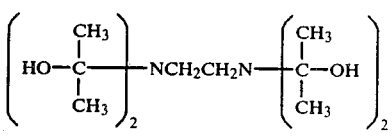

VIII-11

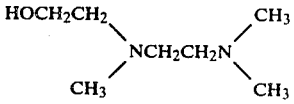

Examples of preferred polyamines are those represented by formula (IX):

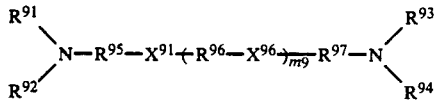

(IX)

wherein $R^{91}$, $R^{92}$, $R^{93}$ and $R^{94}$ each represents a hydrogen atom, an alkyl group, an alkenyl group, an aryl group, an aralkyl group or a heterocyclic group (preferably, the carbon atom number for $R^{91}$, $R^{92}$, $R^{93}$ and $R^{94}$ is from 1 to 10); and $R^{95}$, $R^{96}$ and $R^{97}$ each represents a divalent organic group and is the same as defined above for in formula (VIII).

$R^{91}$, $R^{92}$, $R^{93}$ and $R^{94}$ may have substituents such as an —OH group, a —COOH group, an $-SO_3H$ group, etc.

In formula (IX), $X^{91}$ and $X^{92}$ each represents

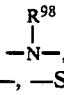

—O—, —S—, —CO—, $—SO_2—$, —SO— or a linking group which is obtained by a combination of these linking groups, $R^{98}$ is the same as defined above for $R^{91}$, $R^{92}$, $R^{93}$ and $R^{94}$; and $m_9$ represents an integer of 0 or more. There is no particular restriction on the upper limit of $m_9$ and the compounds of formula (IX) may have a high molecular weight if the compounds are water-soluble but the preferred range of $m_9$ is usually from 1 to 3.

Specific examples of the compounds represented by formula (IX) are illustrated below.

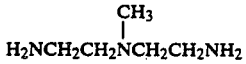

IX-1

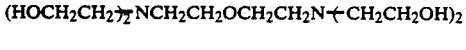

IX-2

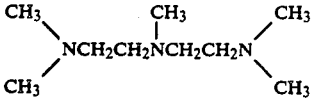

IX-3

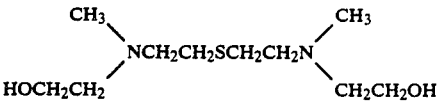

IX-4

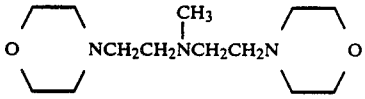

IX-5

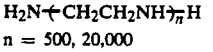

$n = 500, 20{,}000$

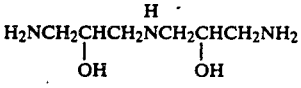

IX-7

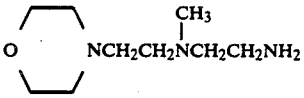

IX-8

Examples of preferred quaternary ammonium salts are those represented by formula (X):

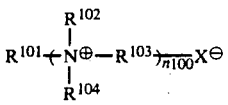

(X)

wherein $R^{101}$ represents an $n_{100}$-valent organic group; $R^{102}$, $R^{103}$ and $R^{104}$ each represents a monovalent organic group, at least two of $R^{102}$, $R^{103}$ and $R^{104}$ may combine with each other to form a heterocyclic ring containing quaternary ammonium atoms (the number of ammonium atoms represents the same as defined below for $n_{100}$; $n_{100}$ represents an integer of 1 or more; and $X^{\ominus}$ represents an anion such as $Cl^{\ominus}$, $Br^{\ominus}$, $I^{\ominus}$, etc.

A particularly preferred monovalent group represented by $R^{102}$, $R^{103}$ and $R^{104}$ is a substituted or unsubstituted alkyl group (preferably having from 1 to 10 carbon atoms) and it is most preferred that at least one of $R^{102}$, $R^{103}$ and $R^{104}$ is a hydroxyalkyl group, an alkoxyalkyl group, or a carboxyalkyl group. Also, $n_{100}$ is preferably an integer of from 1 to 3, and more preferably is 1 or 2.

Specific examples of the compounds represented by formula (X) are illustrated below.

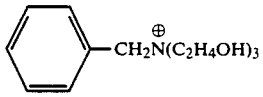

X-1

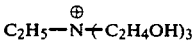

X-2

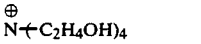

X-3

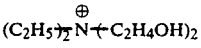

X-4

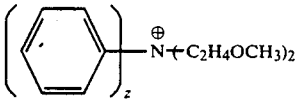

X-5

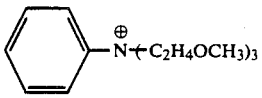

X-6

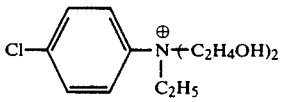

X-7

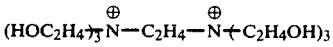

X-8

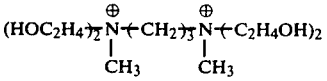

X-9

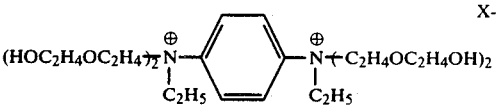

X-10

Examples of preferred nitroxy radicals are those represented by formula (XI):

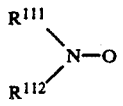

(XI)

wherein $R^{111}$ and $R^{112}$ each represents a hydrogen atom, an alkyl group, an aryl group, or a heterocyclic group. Preferably, the carbon atom number for $R^{111}$ and $R^{112}$ is from 1 to 10.

The alkyl group, aryl group, or heterocyclic group described above may have a substituent and examples of the substituent include a hydroxyl group, an oxo group, a carbamoyl group, an alkoxy group, a sulfamoyl group, a carboxyl group, and a sulfo group.

Examples of the aforesaid heterocyclic group include a pyridyl group and a piperidyl group.

Further, $R^{111}$ and $R^{112}$ are preferably a substituted or unsubstituted aryl group or a tertiary alkyl group (e.g., t-butyl).

Specific examples of the compounds represented by formula (XI) are illustrated below.

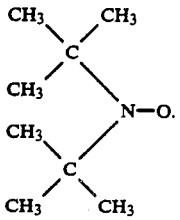

XI-1

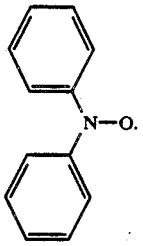

XI-2

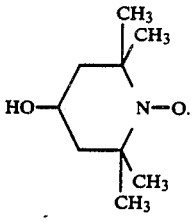

XI-3

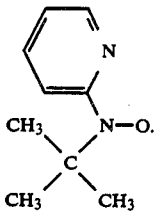

XI-4

-continued

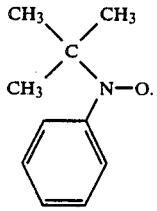

XI-5

Examples of preferred alcohols are those represented by formula (XII):

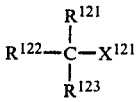

(XII)

wherein $R^{121}$ represents a hydroxy-substituted alkyl group; $R^{122}$ represents an unsubstituted alkyl group or the same group as defined for $R^{121}$; $R^{123}$ represents a hydrogen atom or the same group as defined for $R^{122}$; and $X^{121}$ represents a hydroxy group, a carboxyl group, a sulfo group, a nitro group, an unsubstituted or hydroxysubstituted alkyl group, an unsubstituted or substituted amide group or an unsubstituted or substituted sulfonamide group. Preferably, the carbon atom number for $R^{121}$ and $R^{122}$ is from 1 to 10, and $R^{121}$ and $R^{122}$ may have substituents such as an —OH group, a —COOH group, an —$SO_3H$ group, etc.

In formula (XII), $R^{121}$ is preferably a hydroxyl group, a carboxyl group, or a hydroxyalkyl group.

Specific examples of the compounds represented by formula (XII) are illustrated below.

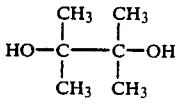

XII-1

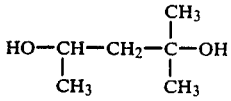

XII-2

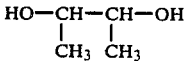

XII-3

$HO—CH(CH_2OH)_2$ XII-4

$(HO—CH_2)_3COOH$ XII-5

$C(CH_2OH)_4$ XII-6

$(HOCH_2)_3C—CH_3$ XII-7

$(HOCH_2)_3C—NHCOCH_3$ XII-8

$(HOCH_2)_2C(CH_3)—SO_3H$ XII-9

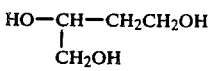

XII-10

Other examples of preferred alcohols are those represented by formula (XIII)

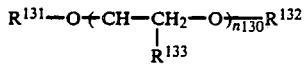

(XIII)

wherein $R^{131}$, $R^{132}$ and $R^{133}$ each represents a hydrogen or an alkyl group; and $n_{130}$ represents a positive integer of 500 or less.

The alkyl group represented by $R^{131}$ and $R^{133}$ preferably contains 5 or less carbon atoms, and more preferably 2 or less carbon atoms. $R^{131}$, $R^{132}$ and $R^{133}$ are most preferably a hydrogen atom or a methyl group, and most preferably a hydrogen atom.

Also, $n_{130}$ is preferably an integer of from 3 to 100, and more preferably from 3 to 30. Specific examples of the compounds represented by formula (XIII) are illustrated below.

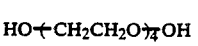

XIII-1

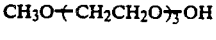

XIII-2

XIII-3

XIII-4

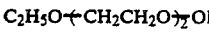

XIII-5

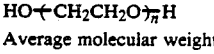

XIII-6

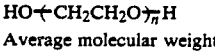

XIII-7

Average molecular weight: about 300

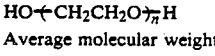

XIII-8

Average molecular weight: about 800

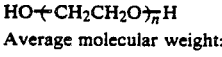

XIII-9

Average molecular weight: about 3000

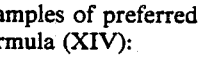

XIII-10

Average molecular weight: about 8000

Examples of preferred oximes are those represented by formula (XIV):

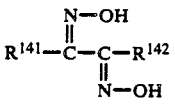

(XIV)

wherein $R^{141}$ and $R^{142}$ each represents a hydrogen atom, a substituted or unsubstituted alkyl group, or a substituted or unsubstituted aryl group, and $R^{141}$ and $R^{142}$ may be the same or different and they may combine with each other.

In formula (XIV), $R^{141}$ and $R^{142}$ are preferably a halogen atom, a hydroxy group, an alkoxy group, an amino group, a carboxyl group, a sulfo group, a phosphonic acid group, a nitro-substituted alkyl group, or an unsubstituted alkyl group.

The sum of the total carbon atoms of the compounds represented by formula (XIV) is preferably 30 or less, and more preferably 20 or less.

Specific examples of the compounds represented by formula (XIV) are illustrated below.

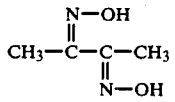

XV-1

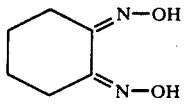

XV-2

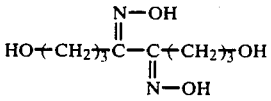

XV-3

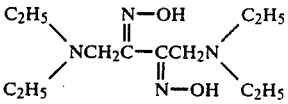

XV-4

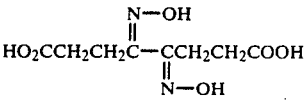

XV-5

Examples of preferred polyamines are those represented by formula (XV):

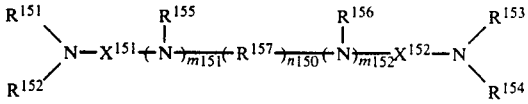

(XV)

wherein $X^{151}$ and $X^{152}$ *represents* —CO— *or* —$SO_2$—; $R^{151}$ $R^{152}$, $R^{153}$, $R^{154}$, $R^{155}$ and $R^{156}$ each represents a hydrogen atom or an unsubstituted or substituted alkyl group; and R157 represents an unsubstituted or substituted alkylene group, an unsubstituted or substituted arylene group, or an unsubstituted or substituted aralkylene group; and $m_{151}$, $m_{152}$ and $n_{150}$ represent 0 or 1. Preferably, the carbon atom number for $R^{151}$, $R^{152}$, $R^{153}$, $R^{154}$, $R^{155}$ and $R^{156}$ is 1 to 10, and $R^{151}$, $R^{152}$, $R^{153}$, $R^{154}$, $R^{155}$ and $R^{156}$ may have substituents such as an —OH group, a —COOH group, an —$SO_3H$ group, etc.

Specific examples of the compound represented by formula (XV) are illustrated below.

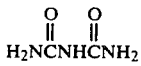

XV-1

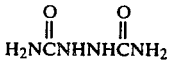

XV-2

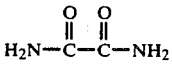

XV-3

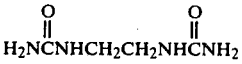

XV-4

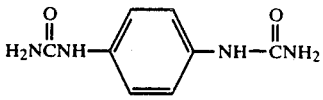

XV-5

-continued $H_2NSO_2NHSO_2NH_2$ XV-6

Examples of preferred condensed cyclic amines are those represented by formula (XVI):

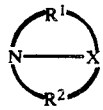

(XVI)

wherein X represents a trivalent atomic group such as

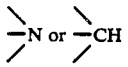

necessary for completing a condensed ring and $R^1$ and $R^2$ each represents an alkylene group, an arylene group, an alkenylene group or an aralkylene group, and $R^1$ and $R^2$ may be the same or different.

In the compounds represented by formula (XVI), the compounds represented by formulae (1-a) and (1-b) are particularly preferred:

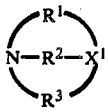

(1-a)

wherein $X^1$ represents

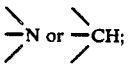

$R^1$ and $R^2$ are the same as defined above for formula (XVI); and $R^3$ represents the same group as $R^1$ *and* $R^2$ or

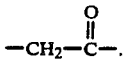

In formula (1-a), $X^1$ is preferably

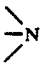

and the number of carbon atoms of each group represented by $R^1$, $R^2$ and $R^3$ is preferably 6 or less, more preferably 3 or less, and most preferably 2.

$R^1$, $R^2$ and $R^3$ are preferably an alkylene group or an arylene group, and most preferably an alkylene group.

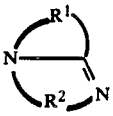

(1-b)

wherein $R^1$ and $R^2$ are the same as defined for formula (XVI).

In formula (1-b), $R^1$ and $R^2$ preferably have 6 or less carbon atoms. $R^1$ and $R^2$ are preferably an alkylene group or an arylene group, and most preferably an alkylene group.

Of the compounds represented by formulae (1-a) and (1-b), the compounds represented by formula (1-a) are particularly preferred.

Specific examples of the compounds represented by formula (XVI) are illustrated below.

XVI-1

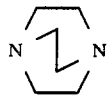

XVI-2

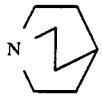

XVI-3

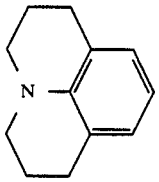

XVI-4

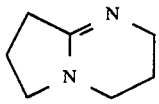

XVI-5

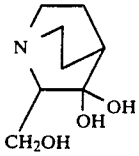

XVI-6

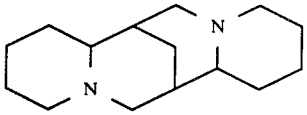

XVI-7

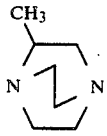

XVI-8

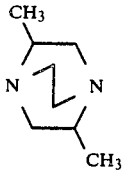

XVI-9

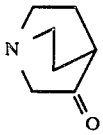

-continued

XVI-10

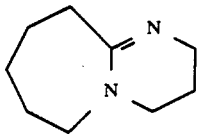

XVI-11

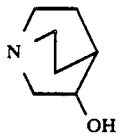

XVI-12

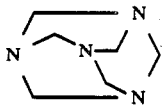

XVI-13

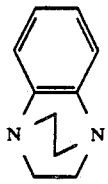

XVI-14

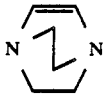

XVI-15

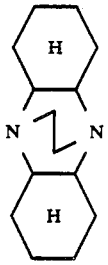

XVI-16

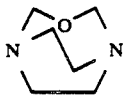

XVI-17

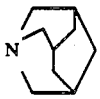

XVI-18

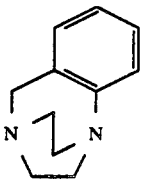

the compounds represented by formula (XVI) for use in the present invention are commercially available.

Of the compounds represented by formulae (VII) to (XVI), those which are represented by formula (VII) and (XVI) are particularly preferred.

The color developers used in the present invention are described below.

The color developer used for the development processing of photosensitive materials of the present invention is preferably an aqueous alkaline solution which contains an aromatic primary amine-based color developing agent as the principal component. Aminophenol-based compounds can also be used as the color developing agent, but the use of p-phenylenediamine-based compounds is preferred. Typical examples of these compounds include 3-methyl-4-amino-N,N-diethylaniline, 3methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and the sulfate, hydrochloride and p-toluenesulfonate of these compounds. Two or more of these compounds can be used in combination, depending on the intended purpose.

The amount of aromatic primary amine developing agent used is from about 0.1 g to about 20 g, and preferably from about 0.5 g to about 10 g, per liter of the developer.

Development accelerators may also be added optionally, if desired, to the color developer. However, with respect to the prevention of fogging, pollution and preparation of solution, the color developers of the present invention are preferably substantially benzyl alcohol free. Here, the term "essentially benzyl alcohol free" means a concentration of 2 ml or less per liter of the developer or, and preferably, the complete absence of benzyl alcohol.

Furthermore, sulfites such as sodium sulfite, potassium sulfite, sodium bisulfite, potassium bisulfite, sodium metasulfite, potassium metasulfite, etc., and carbonyl compound-sulfite adducts can be added, if desired, to the color developer as preservatives. These are added to the color developer in a concentration of from 0 to 20 g per liter, and preferably at a concentration of from 0 to 5 g per liter. Provided that it is able to preserve the color developer, a smaller quantity is preferred. A substantially sulfite ion free system is preferred for improving the color forming properties, and in practice, the concentration (calculated as sodium sulfite) is not more than 0.5 g per liter, and preferably not more than 0.2 g per liter.

Furthermore, the color developers used in the present invention are substantially p-aminophenol-based developing agent free with respect to achieving the effects of the present invention, and especially, with respect to the stability of the developer. In practice, the concentration of a p-aminophenol-based developing agent is generally 1 g or less per liter, and preferably 0.1 g or less per liter.

The color developers generally contain pH buffers such as the carbonates, borates or phosphates of alkali metals; development inhibitors or antifogging agents such as bromides, iodides, benzimidazoles, benzothiazoles or mercapto compounds, etc. They may also contain various preservatives, such as hydroxylamine, diethylhydroxylamine, hydrazine sulfites, phenylsemicarbazides, catechol sulfonic acids, etc.; organic solvents such as ethylene glycol and diethylene glycol; development accelerators such as benzyl alcohol, poly(ethylene glycol), quaternary ammonium salts and amines; color forming couplers; competitive couplers; fogging agents such as sodium borohydride; auxiliary developing agents such as 1-phenyl-3-pyrazolidone; tackifiers; various chelating agents such as aminopolycarboxylic acids, aminopolyphosphonic acids, alkylphosphonic acids and phosphonocarboxylic acids, of which typical examples include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N- N-trimethylenephosphonic acid, ethylenediamine-N,N,N',N'-tetramethylenephosphonic acid, ethylenediaminedi(o-hydroxyphenylacetic acid), and salts of these compounds, if desired.

Color development is carried out after normal black-and-white development in the case of reversal processing. Known black-and-white developing agents (for example, dihydroxybenzenes such as hydroquinone, etc., 3-pyrazolidones such as 1-phenyl-3-pyrazolidone, etc., and aminophenols such as N-methyl-p-aminophenol, etc) can be used individually or in combination for the black-and-white developer.

The pH of these color developers and black-andwhite developers is generally within the range from 9 to 12. Furthermore, the replenishment amount of these developers depends on the color photographic material which is being processed, but is generally 3 liters or less per square meter of photosensitive material and it is possible, by reducing the bromide ion concentration in the replenisher, to use a replenishment amount of not more than 500 ml per square meter of photosensitive material. In the case of a low replenishment amount, the prevention of loss of solution by evaporation and aerial oxidation, by minimizing the contact area with the air in the processing tank, is desirable. Furthermore, the replenishment amount can be reduced by using a means of suppressing the accumulation of bromide inn in the developer.

The photographic emulsion layers are subjected to a normal bleaching process after color development. The bleaching process may be carried out at the same time as the fixing process (in a bleach-fixing process) or it may be carried out as a separate process. Moreover, a bleach-fixing process can be carried out after a bleaching process in order to speed up processing. Moreover, processing can be carried out in two connected bleach-fixing baths, a fixing process can be carried out before carrying out a bleach-fixing process or a bleaching process can be carried out after a bleachfixing process, according to the intended purpose of the processing. Compounds of a polyvalent metal such as iron(III), cobalt(III), chromium(VI), copper(II), etc., peracids, quinones, nitro compounds, etc., can all be used as bleaching agents. Typical bleaching agents include ferricyanides; dichromates; organic complex salts of iron(III) or cobalt(III) (for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diamine tetraacetic acid, etc., or citric acid, tartaric acid, malic acid, etc.); persulfates; bromates; permanganates and nitrobenzenes, etc. Of these materials, the use of the aminopolycarboxylic acid iron(III) complex salts, principally ethylenediaminetetraacetic acid iron(III) complex salts, and persulfates are preferred from the points of view of both rapid processing and the prevention of environmental pollution. Moreover, the aminopolycarboxylic acid iron(III) complex salts are especially useful in both bleaching solutions and bleach-fixing solutions. The pH value of bleaching or bleach-fixing solutions in which the aminopolycarboxylic acid iron(III) complex salts are used is normally from 5.5 to 8, but processing can be carried out at lower pH values in order to speed up processing.

Bleaching accelerators can be used, if desired, in the bleaching baths, bleach-fixing baths, or prebaths of bleach or bleach-fixing. Representative examples of useful bleaching accelerators have been disclosed in the following documents. Compounds which have a mercapto group or a disulfide bond, as disclosed in U.S. Pat. No. 3,893,858, West German Patent 1,290,812, JP-A-53-95630 and in *Research Disclosure* (RD No. 17129) (July, 1978), etc.; the thiazolidine derivatives disclosed in JP-A-50-140129; the thiourea derivatives disclosed in U.S. Pat. No. 3,706,561; the iodides disclosed in JP-A-58-16235; the polyoxyethylene compounds disclosed in West German Patent 2,748,430; the polyamine compounds disclosed in JP-B-45-8836; bromide ion, etc. Among these compounds, those which have a mercapto group or a disulfide group are preferred in view of their large accelerating effect, and the use of the compounds disclosed in U.S. Pat. No. 3,893,858, West German Patent 1,290,812 and JP-A-53-95630 is particularly preferable. Moreover, the use of the compounds disclosed in U.S. Pat. No. 4,552,834 is also preferred. These bleaching accelerators may also be added to the light-sensitive material. These bleaching accelerators are especially effective when bleach-fixing color photosensitive materials for photographic purposes.

Thiosulfates,.thiocyanates, thioether-based compounds, thioureas and large quantities of iodides, etc., can be used as fixing agents, but thiosulfates are generally used for this purpose, and ammonium thiosulfate can be used in a wide range of application. Sulfites or bisulfites, or carbonyl-bisulfite adducts are the preferred preservatives for bleach-fixing solution.

In the present invention, after applying the desilvering treatment such as the fixing or blixing, the silver halide color photographic material thus-processed is generally subjected to a washing step and/or a stabilization step.

The amount of washing water for the washing step is selected in a wide range depending on the characteristics (e.g., materials used therein, such as couplers, etc.) and uses of the color photographic materials being processed, the temperature of the washing water, the number of tanks (stage number), the replenishing system such as countercurrent system, cocurrent system, etc., and other various conditions. The relation of the number of washing tanks and the amount of water in the multistage countercurrent can be determined by the method described in *Journal of the Society of Motion Picture and Television Engineers,* Vol. 64, pp. 248 to 253 (May, 1955).

According to the multistage countercurrent system described in the aforesaid literature, the amount of washing water can be greatly reduced but there occurs a problem that by the increase of the retention time of the watering in the tanks, bacteria breed and floats thus formed adhere to photographic materials.

In the process of the present invention, for overcoming these problems, a method of reducing calcium and magnesium described in JP-A-62-288838 can be very effectively used. Also, chlorine series disinfectants such as isothiazolone compounds as described in JP-A-57-8542, thiabendazoles, chlorinated sodium isocyanurate, etc., benzotriazole, and other disinfectants as described in Hiroshi Horiguchi, *Bokin Bobai no Kaoaku (Antibacterial and Antifuncal Chemistry), Biseibutsu no Mekkin, Sakkin, Bobai Gijutsu (Sterilizino and Antifunoal Tech-*

*niques of Microorganisms),* edited by the Society of Sanitary Technology, and *Bokin Bobaizai Jiten (Handbook of Antibacterial and Antifungal Agents),* edited by the Antibacterial and Antifungal Society of Japan can be used.

The pH of the washing water in the processing of the present invention is from 4 to 9, and preferably from 5 to 8. The temperature of the washing water and the washing time can be desirably selected depending on the characteristics and uses of the color photographic materials being processed but they are selected in the ranges of, generally, from 15° C. to 45° C. and from 20 seconds to 10 minutes, and preferably from 25° C. to 40° C. and from 30 seconds to 5 minutes.

Furthermore, in the present invention, the color photographic materials can be directly processed by a stabilization solution without using the aforesaid washing step. In such a stabilization process, various processes as described in JP-A-57-8543, JP-A-58-14834 and JP-A-60-220345 can be employed Also, when in succession to the aforesaid washing processing, a stabilization process is applied, for example, a stabilization bath containing formalin and a surface active agent, which is used as a final bath for color photographic materials for photography, can be used. Various chelating agents and fungicides can also be added to these stabilizing baths.

The overflow which accompanies replenishment of the above-mentioned washing water and/or stabilizer can be reused in other processes such as the desilvering process, etc.

A color developing agent may also be incorporated into the silver halide color photosensitive materials in the present invention in order to simplify and speed up processing. The incorporation of various color developing agent precursors is preferred. For example, the indoaniline-based compounds disclosed in U.S. Pat. No. 3,342,597, the Schiff base compounds disclosed in U.S. Pat. No. 3,342,599 and *Research Disclosure* (RD Nos. 14850 and 15159), the aldol compounds disclosed in *Research Disclosure* (RD No. 13924), the metal salt complexes disclosed in U.S. Pat. No. 3,719,492, and the urethane-based compounds disclosed in JP-A-53135628 can be used for this purpose.

Various 1-phenyl-3-pyrazolidones may also be incorporated, if desired, into the silver halide color photosensitive materials in the present invention for the purpose of accelerating color development. Typical compounds of this type are disclosed in JP-A-56-64339, JP-A-57-144547 and JP-A-58-115438.

The various processing solution are used at a temperature of from 10 to 50° C in the present invention. The standard temperature is normally from 33 to 38° C, but processing is accelerated and the processing time is shortened at higher temperatures and, conversely, increased picture quality and improved stability of the processing solutions can be achieved at lower temperatures. Furthermore, processes using hydrogen peroxide intensification or cobalt intensification, as disclosed in West German Patent 2,226,770 or U.S. Pat. No. 3,674,499, can be carried out in order to economize on silver in the photosensitive material.

The method of the present invention can be applied to any processing operation provided that the processing is carried out using a color developer. For example, the method of the present invention can be applied to the processing of color papers, color reversal papers, color direct positive photosensitive materials, color positive films, color negative films, color reversal films, etc. However, it is preferably applied to color papers and color reversal papers which are internal-type color photosensitive materials which incorporate color couplers and which are especially prone to staining.

The silver halide emulsions of the photosensitive materials used in the present invention may have any halogen composition, such as silver iodobromide, silver bromide, silver chlorobromide, silver chloride, etc. For example, in cases where rapid processing and low replenishment can be carried out (as with color papers), the use of silver chlorobromide emulsions which have a silver chloride content of at least 60 mol%, or silver chloride emulsion, is preferred. Moreover, emulsions which have a silver chloride content of from 80 to 100 mol% are particularly preferable. Furthermore, when high speed is required and it is necessary to suppress fogging during manufacture, storage and/or processing to an especially low level, the use of silver chlorobromide emulsions which have a silver bromide content of at least 50 mol%, or bromide grain emulsions, is preferred (these may contain 3 mol% or less of silver iodide). Emulsions which have a silver bromide content of at least 70 mol% are particularly preferable. Silver iodobromide and silver chloroiodobromide are preferred for color photosensitive materials for photographic purposes. In such cases, a silver iodide content of from 3 to 15 mol% is preferred.

The silver halide grains for use in the present invention may differ in composition or phase between the inside and the surface layer thereof, may have a multiphase structure having a junction structure, or may have a uniform phase or composition throughout the whole grain. Also, the silver halide grains may be composed of a mixture of such grains having different phase structures.

The average grain size (the diameter of the grain is used when the grain is spherical or resembles spherical, the average value based on the project area using the edge length as the grain size is used when the grain is a cubic grain, or the diameter of the corresponding circle is used when the grain is a tabular grain) of the silver halide grains for use in the present invention is preferably from 0.1 μm to 2 μm, and more preferably from 0.15 μm to 1.5 μm. The grain size distribution of the silver halide emulsion for use in the present invention may be narrow or broad, but a so-called monodispersed silver halide emulsion wherein the value (variation coefficient) obtained by dividing the standard deviation in the grain distribution curve by the average grain size is within about 20%, and preferably within 15%, is preferably used in the present invention. Also, for satisfying the gradation required for the color photographic material, two or more kinds of monodispersed silver halide emulsions (preferably having the abovementioned variation coefficient as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof, or in two or more layers, respectively.

The silver halide grains for use in the present invention may have a regular crystal form such as cubic, octahedral, rhombic dodecahedral or tetradecahedral or a combination thereof, or an irregular crystal form such as spherical, or further a composite form of these crystal forms. Also, a tabular grain silver halide emulsion can be used in the present invention. In particular, a tabular grain silver halide emulsion wherein tabular silver halide grains having an aspect ratio (length/thickness) of 8 or more and preferably 5/1 to 8/1 account for 50% or more of the total projected area of the silver halide grains may be used. The silver halide emulsion for use in the present invention may be a mixture of these emulsions containing silver halide grains each having different crystal forms. Also, the silver halide grains may be of a surface latent image type capable of forming latent images mainly on the surfaces thereof, or of an internal latent image type capable of forming latent images mainly in the inside thereof.

The photographic emulsions for use in the present invention can be prepared by the method described in *Research Disclosure,* Vol. 170, RD No. 17643, I, II, III (December, 1978).

The photographic emulsions are generally subjected to physical ripening, chemical ripening, and spectral sensitization, for use in the present invention. The additives to be used in these steps of ripening and sensitization are described in *Research Disclosure,* Vol. 176, RD No. 17643 (December, 1978) and *ibid.,* Vol. 187, RD No. 18716 (November, 1979), and the relevant parts are summarized in the following Table.

Known photographic additives which can be used in the present invention are also described in the above two *Research Disclosure* publications, and relevant parts are also mentioned in the following Table.

| Additives | RD No. 17643 (Dec., 1978) | RD No. 18716 (Nov. 1979) |
|---|---|---|
| 1. Chemical Sensitizer | Page 23 | Page 648, right column |
| 2. Sensitivity Increasing Agents | — | " |
| 3. Spectral Sensitizer | Pages 23–24 | Page 648, right column to page 649, right column |
| 4. Super Color Sensitizer | " | Page 648, right column to page 649, right column |
| 5. Brightening Agent | Page 24 | — |
| 6. Antifoggant and Stabilizer | Pages 24–25 | Page 649, right column |
| 7. Coupler | Page 25 | Page 649, right column |
| 8. Organic Solvent | Page 25 | — |
| 9. Light Absorbent and Filter Dye | Pages 25–26 | Page 649, right column to page 650, left column |
| 10. UV Absorbent | " | Page 650, left column |
| 11. Stain Inhibitor | Page 25, right column | Page 650, from left to right columns |
| 12. Color Image Stabilizer | Page 25 | — |
| 13. Hardener | Page 26 | Page 651, left column |
| 14. Binder | Page 26 | " |
| 15. Plasticizer and Lubricant | Page 27 | Page 650, right column |
| 16. Coating Aid and Surfactant | Pages 26–27 | " |
| 17. Antistatic Agent | Page 27 | " |

Various kinds of color couplers can be used in the present invention. The color coupler as referred to herein means a compound capable of forming a dye by coupling reaction with the oxidation product of an aromatic primary amine developing agent. Specific examples of useful color couplers include naphthol or phenol series compounds, pyrazolone or pyrazoloazole series compounds and open chain or heterocyclic ketomethylene compounds. Examples of the cyan, magenta and yellow couplers which can be used in the present invention are described in the patent publication as referred to in *Research Disclosure,* RD No. 17643 (December, 1978), VII-D and *ibid.,* RD No. 18717 (November, 1979).

It is preferred that the couplers to be incorporated into the color photographic materials which are processed by the process of the present invention are non-diffusible due to having a ballast group or being polymerized. Also, the use of 2-equivalent color couplers substituted by a releasable group can reduce the amount of silver required for the color photographic materials as compared to 4-equivalent color couplers having a hydrogen atom at the coupling active group. Couplers giving colored dyes having a proper diffusibility, non-color-forming couplers, DIR (development inhibitor releasing) couplers releasing a development inhibitor with coupling reaction, or DAR (development accelerator releasing) couplers releasing a development accelerator with coupling reaction can also be used in the present invention.

Examples of yellow couplers for use in the present invention include oil protect type acylacetamido series couplers as the typical examples Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom-releasing type yellow couplers described in JP-B-55-10739, U.S. Pat. Nos. 4,401,752, 4,326,024, *Research Disclosure,* RD No. 18053 (April, 1979), British Patent 1,425,020, West German Patent Application (Laid-Open) 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

Examples of magenta couplers for use in the present invention include oil protect type indazolone series or cyanoacetyl series couplers, and preferably 5-pyrazolone series magenta couplers and other pyrazoloazole series couplers such as pyrazoloazoles, etc. As the 5-pyrazolone series couplers, those substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896 and 3,936,015, etc. Also, as the releasable groups for the 2-equivalent 5-pyrazolone series couplers, the nitrogen atom-releasing groups described in U.S. Pat. No. 4,310,619, and the arylthio groups described in U.S. Pat. No. 4,351,897 are preferred. Furthermore, the 5-pyrazolone series magenta couplers having a ballast group described in European Patent 73,636 give high coloring density.

Examples of pyrazoloazole series couplers include the pyrazolobenzimidazoles described in U.S. Pat. No. 3,369,879, preferably the pyrazolo[5,1-c][1,2,4]triazoles described in U.S. Pat. No. 3,725,067, the pyrazolotetrazoles described in *Research Disclosure,* RD No. 24220 (June, 1984), and the pyrazolopyrazoles described in *Research Disclosure,* RD No. 24230 (June, 1984). The imidazo[1,2,b]pyrazoles described in European Patent 119,741 are preferred because of the small yellow side absorption of the colored dye and of the sufficient light fastness thereof, and in particular, the pyrazolo[1,5-b][1,2,4]triazoles described in European Patent 119,860 are especially preferred.

Examples of cyan couplers for use in the present invention include oil protect type naphthol series or phenol series couplers Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in the present invention and specific examples of these cyan couplers include the phenol series cyan couplers having an alkyl group of 2 or more carbon atoms at the meta-position of the phenol nucleus described in U.S. Pat. No. 3,772,002; the 2,5-diacylaminosubstituted phenol series cyan couplers described in U.S. Pat. Nos. 2,772,162, 3,758,308, 4,126,396, 4,334,011, 4,327,173, West German Patent (Laid-Open) 3,329,729, JP-A-59-166956, etc.; and the phenol series couplers having a phenylureido group at the 2-position thereof and an acylamino group at the 5-position thereof described in U.S. Pat. Nos. 3,446,622, 4,333,999, 4,451,559 and 4,427,767.

In the process of the present invention, at least one cyan coupler as represented by formula (C-I) is preferably used, whereby excellent photographic characteristics with less fog can be obtained Formula (C-I) is as follows, and is described in further detail hereunder.

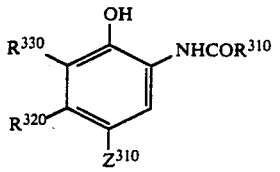

(C-I)

wherein $R^{310}$ represents an alkyl group, a cycloalkyl group, an aryl group, an amino group or a heterocyclic group; $R^{320}$ represents an acylamino group or an alkyl group having 2 or more carbon atoms; $R^{330}$ represents a hydrogen atom, a halogen atom, an alkyl group or an alkoxy group; or $R^{330}$ may be bonded to $R^{320}$ to form a ring; $Z^{310}$ represents a hydrogen atom, a halogen atom or a group capable of being released by the reaction with the oxidation product of an aromatic primary amine color developing agent.

In formula (C-I), the alkyl group for $R^{310}$ has from 1 to 32 carbon atoms, and is, for example, a methyl group, a butyl group, a tridecyl group, a cyclohexyl group, an allyl group, etc.; the aryl group is, for example, a phenyl group, a naphthyl group, etc.; and the heterocyclic group is, for example, a 2-pyridyl group, a 2-furyl group, etc.

When $R^{310}$ is an amino group, it is preferably an optionally substituted phenyl-substituted amino group.

$R^{310}$ may further be substituted by substituent(s) selected from an alkyl group; an aryl group; an alkyloxy or aryloxy group (e.g., methoxy, dodecyloxy, methoxyothoxy, phenyloxy, 2,4-di-tert-amylphenoxy, 3-tert-butyl-4-hydroxyphenyloxy, naphthyloxy); a carboxyl group; an alkylcarbonyl or arylcarbonyl group (e.g., acetyl, tetradecanoyl, benzoyl); an alkyloxycarbonyl or aryloxycarbonyl group (e.g., methoxycarbonyl, phenoxycarbonyl); an acyloxy group (e.g., acetyloxy, benzoyloxy); a sulfamoyl group (e.g., N-ethylsulfamoyl, N-octadecylsulfamoyl]; a carbamoyl group (e.g., N-ethylcarbamoyl, N-methyldodecylcarbamoyl); a sulfonamide group (e.g , methanesulfonamide, benzenesulfonamide); an acylamino group (e.g., acetylamino, benzamide, ethoxycarbonylamino, phenylaminocarbonylamino); an imide group (e.g., succinimide, hydantoinyl); a sulfonyl group (e.g., methanesulfonyl); a hydroxyl group; a cyano group; a nitro group; and a halogen atom.

In formula (C-I), $Z^{310}$ represents a hydrogen atom or a coupling-releasable group. Examples of the coupling-releasable group are a halogen atom (e.g., fluorine, chlorine, bromine); an alkoxy group (e.g., dodecyloxy, methoxycarbamoylmethoxy, carboxypropyloxy, methylsulfonylethoxy); an aryloxy group (e.g., 4-chlorophenoxy, 4-methoxyphenoxy); an acyloxy group (e.g., acetoxy, tetradecanoyloxy, benzoyloxy); a sulfonyloxy group (e.g., methanesulfonyloxy, toluenesulfonyloxy); an amido group (e.g., dichloroacetylamino, methanesulfonylamino, toluenesulfonylamino; an alkoxycarbonyloxy group (e.g., ethoxycarbonyloxy, benzyloxycarbonyloxy); an aryloxycarbonyloxy group (e.g., phenoxycarbonyloxy); an aliphatic or aromatic thio group (e.g., phenylthio, tetrazolylthio); an imido group (e.g., succinimido, hydantoinyl); an N-heterocyclic group (e.g., 1-pyrazolyl, 1-benzotriazolyl); an aromatic azo group (e.g., phenylazo), etc. These releasable groups can contain a photographically useful group.

The compound of formula (C-I) may form a dimer or a polymer at the position of $R^{310}$ or $R^{320}$.

Specific examples of the cyan couplers of the above-mentioned formula (C-I) are described below, but such is not intended to restrict the scope of the present invention.

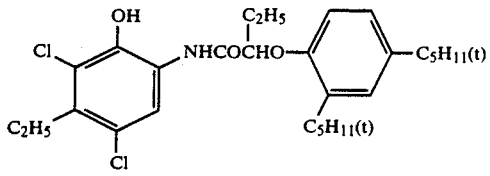

(C-1)

-continued
(C-2)
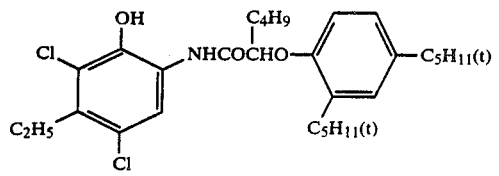
(C-3)
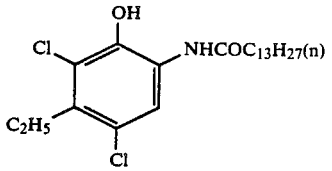
(C-4)
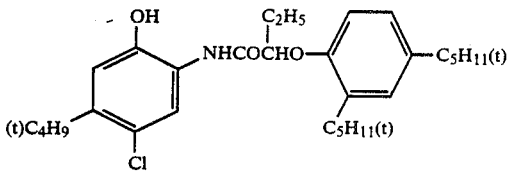
(C-5)
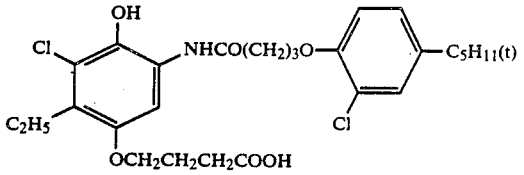
(C-6)
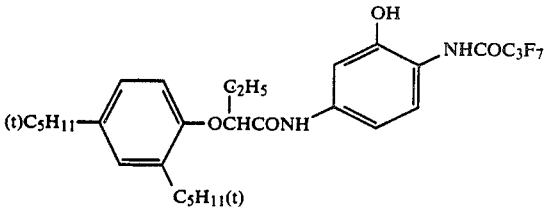
(C-7)
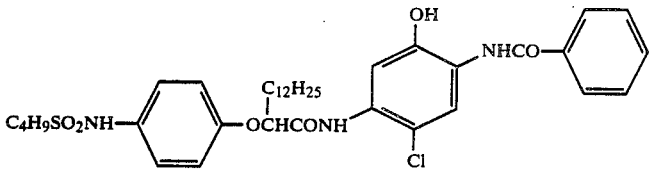
(C-8)
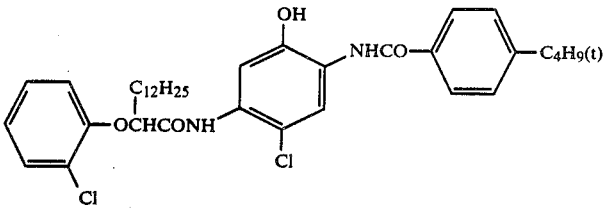
(C-9)
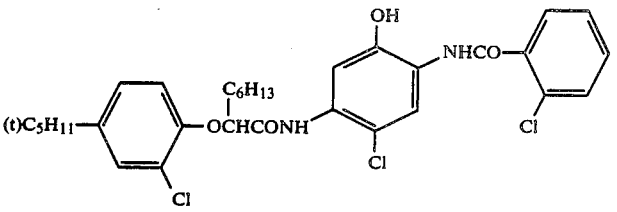

-continued
(C-10)
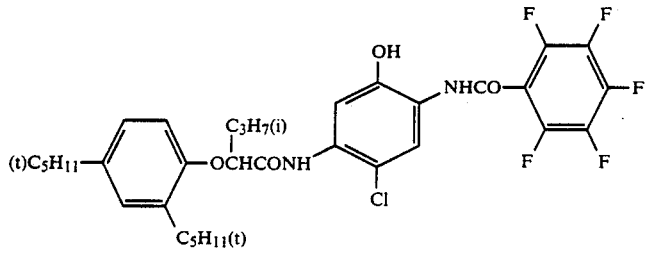
(C-11)
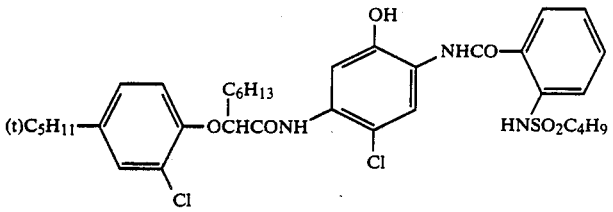
(C-12)
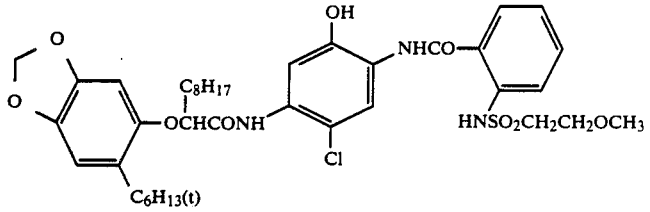
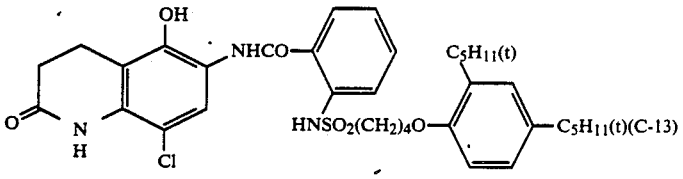
(C-14)
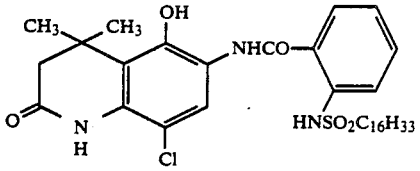
(C-15)
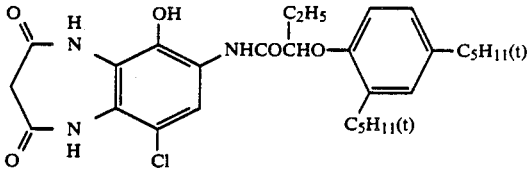
(C-16)
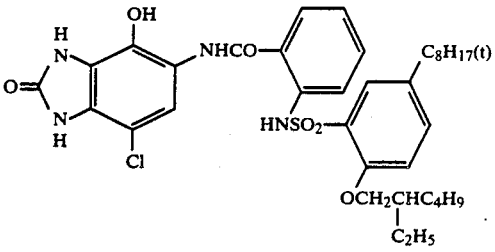

-continued
(C-17)
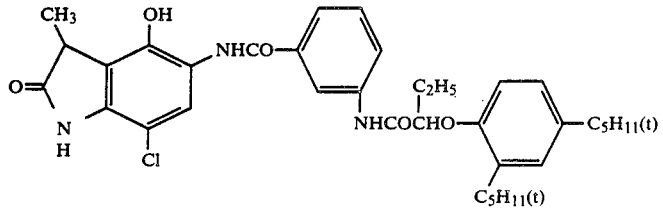
(C-18)
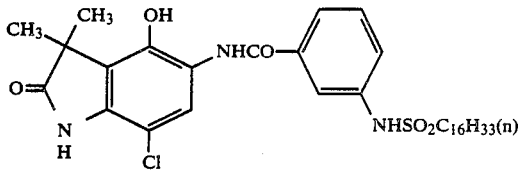
(C-19)
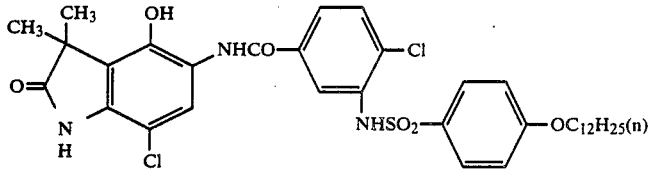
(C-20)
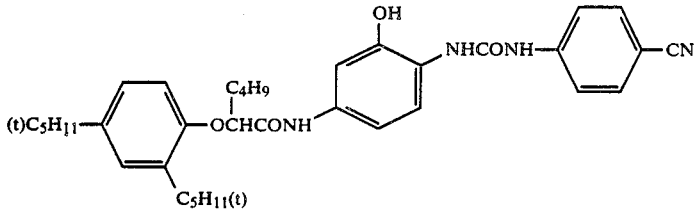
(C-21)
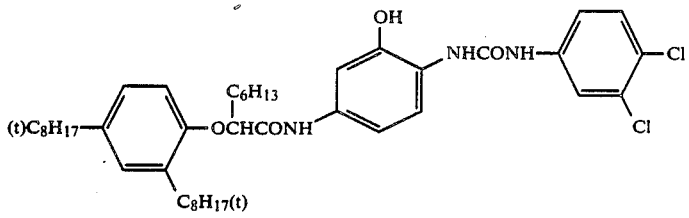
(C-22)
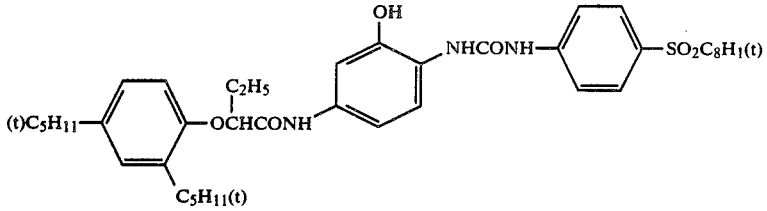
(C-23)
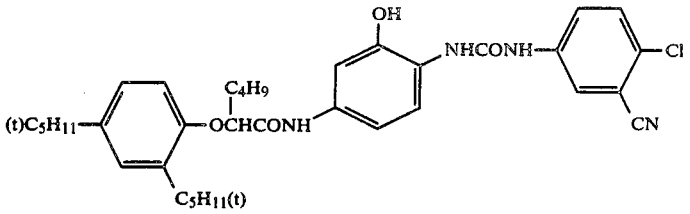

-continued (C-24)

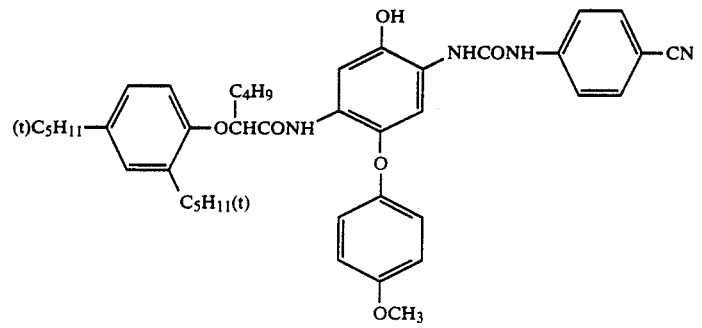

(C-25)

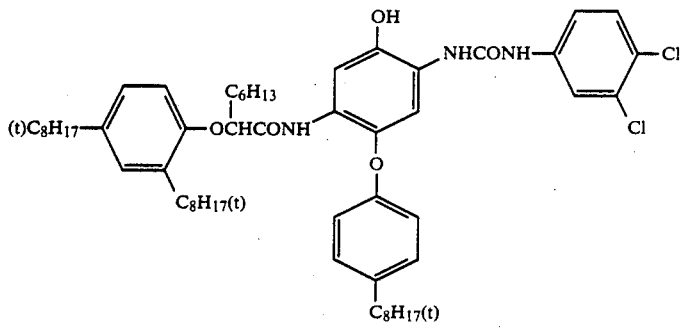

(C-26)

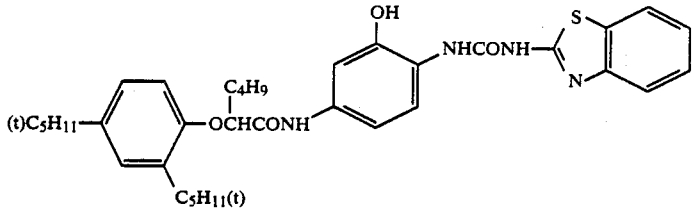

The cyan couplers of the above-mentioned formula (C-I) can be produced, e.g., in accordance with the descriptions of JP-A-59-166956 and JP-B-49-11572, etc.

In the present invention, by using couplers giving colored dyes having a proper diffusibility together with the aforesaid color couplers, the graininess of color images formed can be improved Specific examples of couplers giving such diffusible dyes are described in U.S. Pat. No. 4,366,237 and British Patent 2,125,570, and specific examples of yellow, magenta and cyan couplers of this type are described in European Patent 6,570 and West German Patent (Laid-Open) 3,234,533.

The dye-forming couplers and the abovedescribed specific couplers for use in the present invention may form dimers or polymers. Typical examples of the polymerized dye-forming couplers are described in U.S. Pat. Nos. 3,451,820 and 4,080,211. Also, specific examples of the polymerized magenta couplers are described in British patent 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic material, or the same kind of coupler may be used in two or more photographic layers for meeting desired characteristics.

The couplers for use in the present invention can be incorporated into the photographic light-sensitive materials by means of various known dispersion methods. For instance, an oil-in-water dispersion method can be mentioned as one example, and examples of high boiling point organic solvents which can be used in the oil-in-water dispersion method are described, e.g., in U.S. Pat. No. 2,322,027, etc. Another example is a latex dispersion method, and the procedure, effect, and examples of latexes to be used for impregnation are described in U.S. Pat. No. 4,199,363, West German Patents (Laid-Open) 2,541,274 and 2,541,230, etc.

The standard amount of the color coupler to be incorporated is in the range of from 0.001 to 1 mol per mol of the light-sensitive silver halide in the silver halide emulsion and the preferred amount is from 0.01 to 0.5 mol for yellow coupler, from 0.003 to 0.3 mol for magenta coupler and from 0.002 to 0.3 mol for cyan coupler.

The photographic light-sensitive material for use in the present invention is coated on a conventional flexible support such as plastic films (e.g., cellulose nitrate, cellulose acetate, polyethylene terephthalate, etc.) or paper or a conventional rigid support such as glass, etc. The details of the supports and the coating means are described in *Research Disclosure*, RD No. 17643, XV (page 27) and XVII (page 28) (December, 1978).

In the present invention, a reflective support is preferably used.

The "reflective support" has a high reflectivity for clearly viewing the dye images formed in silver halide emulsion layers of the color photographic material, and this includes a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as described above.

The following examples are intended to illustrate the present invention but not to limit it in any way. Unless otherwise indicated, all percents, ratios and the like are by weight.

EXAMPLE 1

A color developer having the following composition was prepared.

| Color Developer: | |
|---|---|
| Compound A (compounds of the present invention) | See Table 1 |
| Compound B (compounds used in combination) | See Table 1 |
| Sodium Sulfate | 0.2 g |
| Potassium Carbonate | 30 g |
| EDTA.2Na | 1 g |
| Sodium Chloride | 1.5 g |
| 4-Amino-3-methyl-N-ethyl-N-[β-(methanesulfonamido)ethyl]aniline.sulfate | 5.0 g |
| Brightening Agent (UVITEX-CK, 4,4,-diaminostilbene series brightening agent, manufactured by Ciba Geigy Co.) | 3.0 g |
| Water to make | 1,000 ml |
| pH | 10.05 |

Samples (Nos. 1-1 to 1-20) of the thus-prepared color developer were put in test tubes each with an open coefficient (opening area/sample volume) of 0.04 $cm^{-1}$ and kept at 35° C. for 6 weeks. After 6 weeks, the decrement by evaporation was compensated for by addition of distilled water to the samples, and then the retention percentage of the aromatic primary amine color developing agent in the developer solution was measured and calculated by liquid chromatography. The results obtained are shown in Table 1 below.

The results of Table 1 demonstrate that the retention percentage of the developing agent could be somewhat improved by the addition of the compound of triethanolamine, or sodium sulfite (Sample Nos. 1-3, 1-4 and 1-5), as opposed to the single use of the hydroxylamine or diethylhydroxylamine (Sample Nos. 1—1 and 1—2), but such improvement could not be said sufficient.

However, the results of Sample Nos. 1-6 to 1-26 in Table 1 clearly demonstrate that the retention percentage of the developing agent was extremely improved by the use of the compound of formula (I), so that the preservation of the color developer was improved. Moreover, a greater effect was obtained when compounds represented by formulae (VII) to (XVI) were used simultaneously, and particularly the combined use of Compounds VII-1, XVI-1 and XVI-7 is preferred.

TABLE 1

| Sample No. | Compound A*1 (0.03 mol/l) | Compound B*2 (0.03 mol/l) | Remarks | Retention*3 Pecentage of Developing Agent (%) |
|---|---|---|---|---|
| 1-1 | Hydroxylamine sulfate | — | Comparison | 5 |
| 1-2 | Diethylhydroxylamine | — | " | 8 |
| 1-3 | " | Triethanolamine (VII-1) | " | 45 |
| 1-4 | " | Sodium sulfite | " | 47 |
| 1-5 | Hydroxylamine sulfate | " | " | 50 |
| 1-6 | I-5 | — | Invention | 85 |
| 1-7 | I-6 | — | " | 80 |
| 1-8 | I-12 | — | " | 75 |
| 1-9 | I-13 | — | " | 74 |
| 1-10 | I-20 | — | " | 74 |
| 1-11 | I-21 | | " | 78 |
| 1-12 | I-5 | Sodium sulfite | " | 93 |
| 1-13 | " | VII-1 | " | 98 |
| 1-14 | " | VII-1 | " | 93 |
| 1-15 | " | VII-6 | " | 95 |
| 1-16 | " | IX-1 | " | 91 |
| 1-17 | " | IX-8 | " | 90 |
| 1-18 | I-5 | X-4 | Invention | 89 |
| 1-19 | " | XI-1 | " | 88 |
| 1-20 | " | XI-3 | " | 90 |
| 1-21 | " | XII-1 | " | 92 |
| 1-22 | " | XIII-1 | " | 91 |
| 1-23 | " | XIV-1 | " | 92 |
| 1-24 | " | XV-1 | " | 94 |
| 1-25 | " | XVI-1 | " | 99 |
| 1-26 | " | XVI-7 | " | 100 |

*1Number of the compound described hereinbefore
*2Number of the compound described hereinbefore $$*^3\text{Retention percentage of developing agent} = \frac{\text{Concentration of developing agent remained}}{5.0\ \text{g/liter}} \times 100$$

EXAMPLE 2

A multilayer printing paper of the layer structure indicated below was prepared on a paper support which had been laminated on both sides with polyethylene.

Preparation of the First Layer Coating Liquid:

Yellow Couplers ExY-1 and ExY-2 (10.2 g and 9.1 g, respectively) and 4.4 g of Colored Image Stabilizer Cpd-1 were dissolved in 27.2 ml of ethyl acetate and 7.7 ml (8.0 g) of High Boiling Point Solvent Solv-1, and the resulting solution was emulsified and dispersed in 185 ml of a 10 wt% aqueous solution of gelatin which contained 8 ml of 10 wt% sodium dodecylbenzenesulfonate. The emulsified dispersion was mixed with Emulsions EM1 and EM2 to form a solution and the first layer containing solution was obtained by adjusting the gelatin concentration so as to provide the composition indicated below. The coating solutions for second to seventh layers were prepared in the same way as that for the first layer. 1-Oxy-3,5-dichloro-s-triazine sodium salt was used in each layer as a gelatin hardening agent.

Compound Cpd-2 was also used as a thickener.

Layer Structure

The composition of the layers were as indicated below. The numerical values represent the amounts coated (g/m$^2$). The coated amounts of the silver halide emulsions are indicated after calculation as silver.

Support

Polyethylene laminated paper (white pigment ($TiO_2$) and a bluing dye were included in the polyethylene on the side of the first layer)

| | |
|---|---|
| First Layer: Blue-Sensitive Layer | |
| Monodisperse Silver Chlorobromide Emulsion EMI which had been spectrally sensitized with Sensitizing Dye ExS-1 | 0.13 |
| Monodisperse Silver Chlorobromide Emulsion EM2 which had been spectrally sensitized with Sensitizing Dye ExS-1 | 0.13 |
| Gelatin | 1.86 |
| Yellow Coupler ExY-1 | 0.44 |
| Yellow Coupler ExY-2 | 0.39 |
| Colored Image Stabilizer Cpd-1 | 0.19 |
| Solvent Solv-1 | 0.35 |
| Second Layer: Anti-Color-Mixing Layer | |
| Gelatin | 0.99 |
| Anti-Color-Mixing Agent Cpd-3 | 0.08 |
| Third Layer: Green-Sensitive Layer | |
| Monodisperse Silver Chlorobromide Emulsion EM3 which had been spectrally sensitized with Sensitizing Dyes ExS-2, ExS-3 | 0.05 |
| Monodisperse Silver Chlorobromide Emulsion EM4 which had been spectrally sensitized with Sensitizing Dyes ExS-2, ExS-3 | 0.11 |
| Gelatin | 1.80 |
| Magenta Coupler ExM-1 | 0.39 |
| Colored Image Stabilizer Cpd-4 | 0.20 |
| Colored Image Stabilizer Cpd-5 | 0.02 |
| Colored Image Stabilizer Cpd-6 | 0.03 |
| Solvent Solv-2 | 0.12 |
| Solvent Solv-3 | 0.25 |
| Fourth Layer: Ultraviolet Absorbing Layer | |
| Gelatin | 1.60 |

-continued

| | |
|---|---|
| Ultraviolet Absorber (Cpd-7/Cpd-8/Cpd-9 = 3/2/6 by weight) | 0.70 |
| Anti-Color-Mixing Agent Cpd-10 | 0.05 |
| Solvent Solv-4 | 0.27 |
| Fifth Layer: Red-Sensitive Layer | |
| Monodisperse Silver Chlorobromide Emulsion EM5 which had been spectrally sensitized with Sensitizing Dyes ExS-4, ExS-5 | 0.07 |
| Monodisperse Silver Chlorobromide Emulsion EM6 which had been spectrally sensitized with Sensitizing Dyes ExS-4, ExS-5 | 0.16 |
| Gelatin | 0.92 |
| Cyan Coupler (see Table 2) | 0.32 |
| Colored Image Stabilizer (Cpd-8/Cpd-9/Cpd-12 = 3/4/2 by weight) | 0.17 |
| Polymer for dispersion purposes Cpd-11 | 0.28 |
| Solvent Solv-2 | 0.20 |
| Sixth Layer: Ultraviolet Absorbing Layer | |
| Gelatin | 0.54 |
| Ultraviolet Absorber (Cpd-7/Cpd-9/Cpd-12 = 1/5/3 by weight) | 0.21 |
| Solvent Solv-2 | 0.08 |
| Seventh Layer: Protective Layer | |
| Gelatin | 1.33 |
| Acrylic modified poly(vinyl alcohol) copolymer (degree of modification: 17%) | 0.17 |
| Liquid paraffin | 0.03 |

Furthermore, Cpd-13 and Cpd-14 were used as antiirradiation dyes.

Moreover, "Alkanol B" (Du Pont Co.), sodium alkylbenzenesulfonate, succinic acid ester and "Magefacx F-120" (Dainippon Ink Co.) were used in each layer as emulsification and dispersing agents and coating aids. Compounds Cpd-15, Cpd-16 were also used as silver halide stabilizer.

Details of the emulsions used are indicated below.

| Emulsion | Form | Grain Size (μm) | Br Content (mol %) | Variation Coefficient* |
|---|---|---|---|---|
| EM1 | Cubic | 1.0 | 80 | 0.08 |
| EM2 | Cubic | 0.75 | 80 | 0.07 |
| EM3 | Cubic | 0.5 | 83 | 0.09 |
| EM4 | Cubic | 0.4 | 83 | 0.10 |
| EM5 | Cubic | 0.5 | 73 | 0.09 |
| EM6 | Cubic | 0.4 | 73 | 0.10 |

*This represents the grain distribution of the grains $$\text{Variation Coefficient} = \frac{\text{Standard Diviation}}{\text{Average Size}}$$

The structural formulae of the compounds used are indicated below.

ExY-1

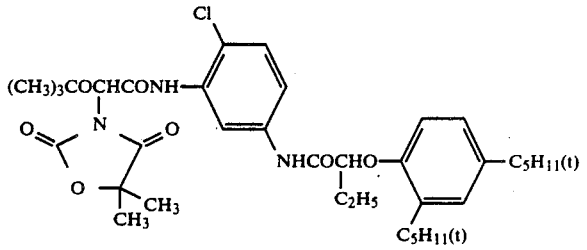

-continued
ExY-2
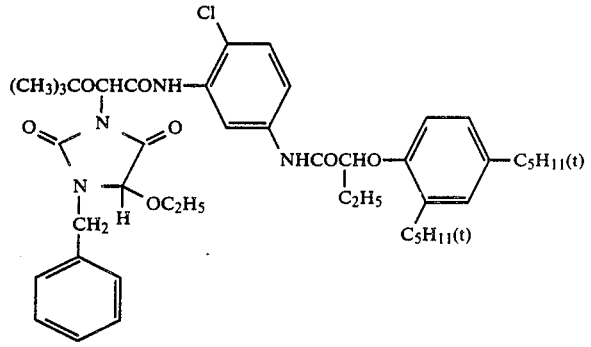
ExM-1
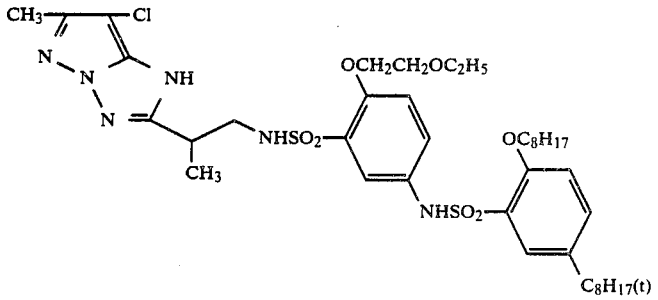
ExS-1
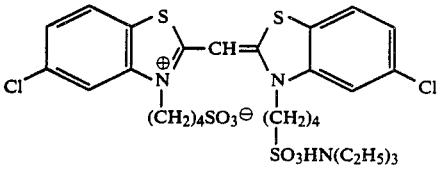
ExS-2
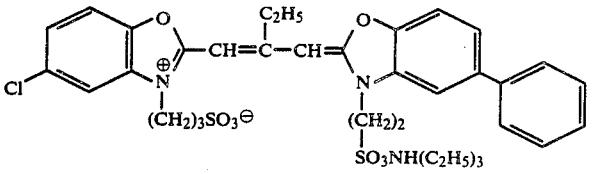
ExS-3
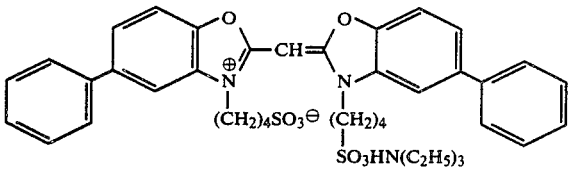
ExS-4
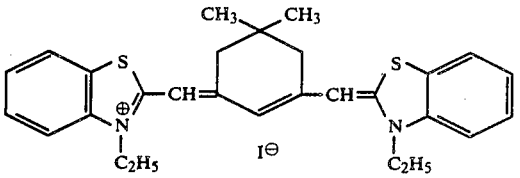

-continued
ExS-5
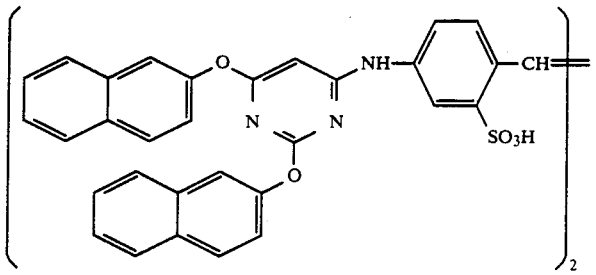
Cpd-1
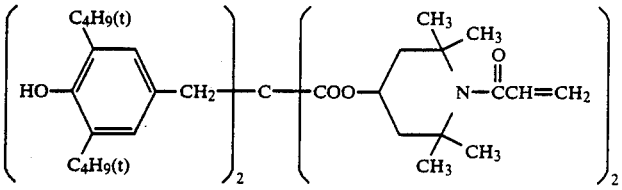
Cpd-2
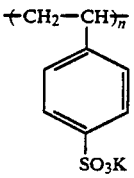
Cpd-3
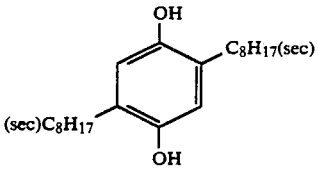
Cpd-4
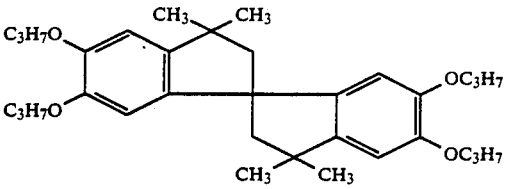
Cpd-5
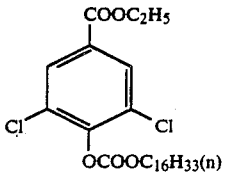
Cpd-6
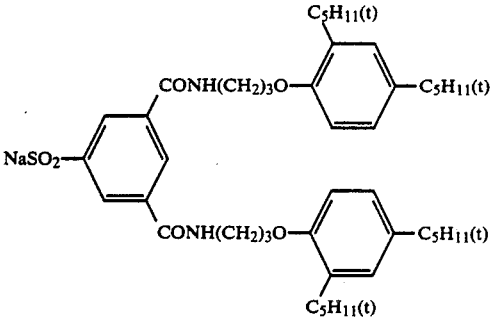

-continued
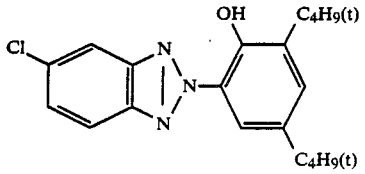
Cpd-7
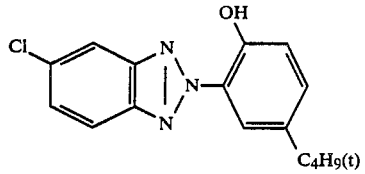
Cpd-8
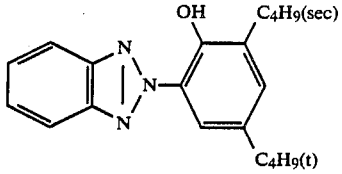
Cpd-9
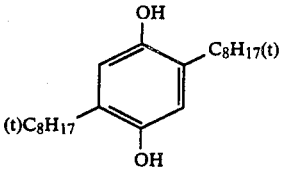
Cpd-10
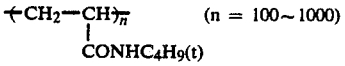
(n = 100~1000)
Cpd-11
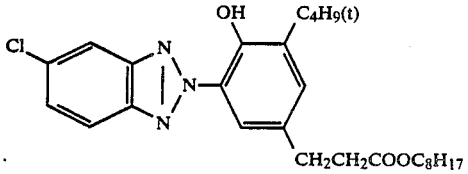
Cpd-12
| | |
|---|---|
| Dibutyl phthalate | Solv-1 |
| Tricresyl phosphate | Solv-2 |
| Trioctyl phosphate | Solv-3 |
| Trinonyl phosphate | Solv-4 |
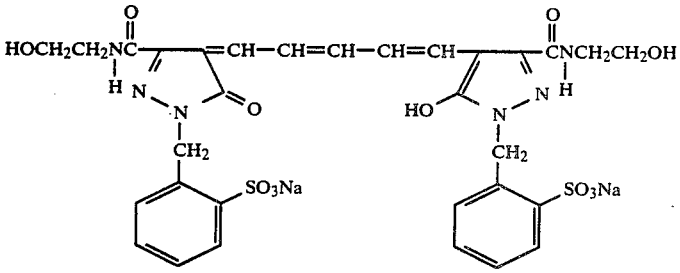
Cpd-13
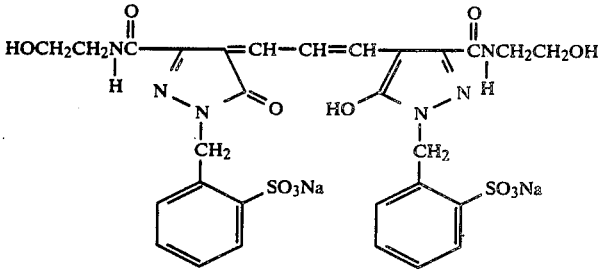
Cpd-14

-continued

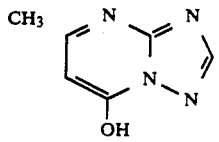

Cpd-15

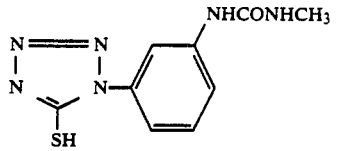

Cpd-16

Color printing papers containing various cyan couplers were prepared as shown in Table 2.

The above-mentioned photosensitive materials were processed in the manner indicated below after exposure through an optical wedge.

| Processing Step | Temperature (°C.) | Time |
|---|---|---|
| Color Development | 38 | 1 min 40 sec |
| Bleach-fixing | 30–34 | 1 min 00 sec |
| Rinse (1)* | 30–34 | 20 sec |
| Rinse (2) | 30–34 | 20 sec |
| Rinse (3) | 30–34 | 20 sec |
| Drying | 70–80 | 50 sec |

*Rinsing was carried out using three tank countercurrent system from rinse (3) to rinse (1)

The composition of each processing bath was as indicated below.

| Color Development Solution: | |
|---|---|
| Water | 800 ml |
| Compound A of the Present Invention (compound of the present invention) | See Table 2 |
| Compound B (used in combination) | See Table 2 |
| Diethylenetriaminepentaacetic Acid | 1.0 g |
| 1-Hydroxyethylidene-1,1-diphosphonic Acid (60 wt %) | 2.0 g |
| Nitrilotriacetic Acid | 2.0 g |
| Benzyl Alcohol | See Table 2 |
| Diethylene Glycol | 10 ml |
| Sodium Sulfite | See Table 2 |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| Brightening Agent (4,4'-diaminostilbene-based, "WHITEX 4", manufactured by Sumitomo Chemical Co., Ltd.) | 1.5 g |
| Water to make | 1,000 ml |
| pH | 10.25 |

-continued

| Bleach-Fixing Solution: | |
|---|---|
| Water | 400 ml |
| Ammonium Thiosulfate (700 g/liter) | 200 ml |
| Sodium Sulfite | 20 g |
| Ethylenediaminetetraacetic Acid Iron (III) Ammonium Salt | 60 g |
| Ethylenediaminetetraacetic Acid Disodium Salt | 10 g |
| Water to make | 1,000 ml |
| pH (25° C.) | 7.00 |
| Rinsing Solution: | |
| Benzotriazole | 1.0 g |
| Ethylenediamine-N,N,N',N'-tetra-methylenephosphonic Acid | 0.3 g |
| Water to make | 1,000 ml |
| pH (25° C.) | 7.5 |

On the other hand, part of each of the abovementioned color development solutions was placed in a 1 liter beaker and left to stand open at 30° C. for a period of 40 days, after which the aged solution was used to process the material under the conditions described above.

Processing carried out using the color development solutions (aged solutions) which had been left to stand for 40 days were referred to as aged solution tests and processing carried out using the color development solution (fresh solutions) prior to standing were referred to as fresh solution tests.

The photographic characteristics obtained in the fresh solution tests and the aged solution tests were as shown in Table 2.

The photographic properties were represented by $D_{min}$ for the cyan density and the gradation at two points.

$D_{min}$ represents the minimum density and the gradation was represented by the change in density from the point representing a density of 0.5 to a point of density 0.3 higher on the higher exposure side with log E.

TABLE 2

| | | Color Developer Additives | | | | | Photographic Characteristics | | | |
|---|---|---|---|---|---|---|---|---|---|---|
| | | | | | | | Fresh Solution | | Aged Solution | |
| No. | Cyan Coupler | Compound A (0.04 mol/l) | Compound B (0.03 mol/l) | Benzyl Alcohol (ml/l) | Sodium Sulfite (mol/l) | Remarks | $D_{min}$ | Gradation | $D_{min}$ | Gradation |
| 2-1 | C-3 | Hydroxylamine | VII-1 | — | — | Comparison | 0.10 | 0.81 | 0.16 | 0.90 |
| 2-2 | C-1 | " | " | — | — | " | 0.10 | 0.82 | 0.17 | 0.91 |
| 2-3 | " | " | " | — | $1.5 \times 10^{-2}$ | " | 0.10 | 0.77 | 0.15 | 0.88 |
| 2-4 | " | I-5 | " | — | — | Invention | 0.10 | 0.83 | 0.10 | 0.84 |
| 2-5 | " | I-6 | " | — | — | " | 0.10 | 0.84 | 0.11 | 0.86 |
| 2-6 | " | I-12 | " | — | — | " | 0.10 | 0.84 | 0.11 | 0.86 |
| 2-7 | " | I-5 | " | — | $0.5 \times 10^{-2}$ | " | 0.10 | 0.81 | 0.10 | 0.84 |
| 2-8 | " | " | " | — | $1.5 \times 10^{-2}$ | " | 0.10 | 0.77 | 0.10 | 0.81 |
| 2-9 | " | " | " | 5 | — | " | 0.10 | 0.84 | 0.12 | 0.86 |
| 2-10 | " | " | " | 10 | — | " | 0.10 | 0.86 | 0.13 | 0.89 |

TABLE 2-continued

| No. | Cyan Coupler | Color Developer Additives: Compound A (0.04 mol/l) | Compound B (0.03 mol/l) | Benzyl Alcohol (ml/l) | Sodium Sulfite (mol/l) | Remarks | Photographic Characteristics: Fresh Solution $D_{min}$ | Fresh Solution Gradation | Aged Solution $D_{min}$ | Aged Solution Gradation |
|---|---|---|---|---|---|---|---|---|---|---|
| 2-11 | A* | " | " | — | — | " | 0.10 | 0.82 | 0.12 | 0.83 |
| 2-12 | B* | " | " | — | — | " | 0.10 | 0.81 | 0.12 | 0.83 |
| 2-13 | C-3 | " | " | — | — | " | 0.10 | 0.84 | 0.10 | 0.84 |
| 2-14 | " | " | XVI-1 | — | — | " | 0.10 | 0.84 | 0.10 | 0.84 |
| 2-15 | C-1 | " | " | — | — | " | 0.10 | 0.83 | 0.10 | 0.83 |
| 2-16 | A* | " | XVI-7 | — | — | " | 0.10 | 0.82 | 0.11 | 0.84 |
| 2-17 | B* | " | " | — | — | " | 0.10 | 0.81 | 0.12 | 0.84 |
| 2-18 | C-3 | " | " | — | — | " | 0.10 | 0.84 | 0.10 | 0.84 |
| 2-19 | C-1 | " | " | — | — | " | 0.10 | 0.83 | 0.10 | 0.83 |

*Cyan Couplers

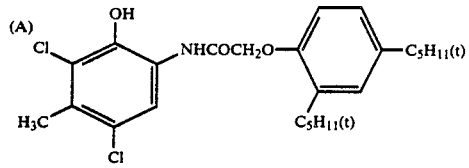

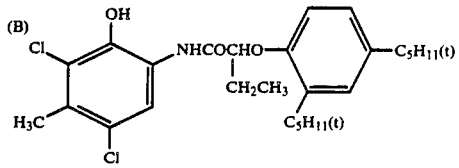

There was a marked change in the photographic characteristics with the aged development solution in Comparative Sample Nos. 2-1 to 2-3. However, the change in photographic characteristics was slight in Sample Nos. 2-4 to 2-19 of the present invention. Especially good results were obtained when the preferred cyan coupler was used, and when the amounts of benzyl alcohol and sodium sulfite added were small.

Good photographic characteristics were obtained with the present invention upon processing in the same manner as in Example 2, except that the rinsing solutions were replaced with ion exchanged water of which the calcium and magnesium contents were 3 ppm or less.

EXAMPLE 3

Similarly, good photographic characteristics were obtained when similar tests were carried out using Compounds I-1, I-2, I-13, I-16, I-20, I-21, I-25 and I-30 in place of Compound I-5 used in Sample Nos. 2-13, 2-15 and 2 18 in Example 2.

EXAMPLE 4

Similarly, good photographic characteristics were obtained when these tests were carried out using Compounds C-6, C-9, C-12, C-16, C-21 and C-25 in place of Cyan Coupler C-3 used in Sample No. 2-18 in Example 2.

EXAMPLE 5

A multilayer printing paper of the layer structure indicated below was prepared on a paper support which had been laminated on both sides with polyethylene

Preparation of the First Layer Coating Solution

Yellow Coupler ExY-(1) (10.1 g) and 4.4 g of Colored Image Stabilizer Cpd-(2) were dissolved in 27.2 ml of ethyl acetate and 7.7 ml (8.0 g) of High Boiling Point Solvent Solv-(1), and the resulting solution was emulsified and dispersed in 185 ml of a 10 wt% aqueous solution of gelatin which contained 8 ml of 10 wt% sodium dodecylbenzenesulfonate. The emulsified dispersion was mixed with Emulsions EM7 and EM8 to form a solution and the first layer coating solution was obtained by adjusting the gelatin concentration so as to provide the composition indicated below. The coating solution for second to seventh layers were prepared in the same manner as that for the first layer. 1-Oxy-3,5-dichloro-s-triazine sodium salt was used in each layer as a gelatin hardening agent.

Compound Cpd-(1) was also used as a thickener.

Layer Structure

The compositions of the layers were as indicated below. The numerical values represent the amounts coated (g/m$^2$). The coated amounts of the silver halide emulsions are indicated after calculation as silver.

Support

Polyethylene laminated paper (white pigment ($TiO_2$) and a bluing dye were included in the polyethylene on the side of the first layer)

| | |
|---|---|
| First Layer: Blue-Sensitive Layer | |
| Monodisperse Silver Chlorobromide Emulsion EM7 which had been spectrally sensitized with Sensitizing Dye ExS-(1) | 0.15 |
| Monodisperse Silver Chlorobromide Emulsion EM8 which had been spectrally sensitized with Sensitizing Dye ExS-(1) | 0.15 |
| Gelatin | 1.86 |
| Yellow Coupler ExY-(1) | 0.82 |
| Colored Image Stabilizer Cpd-(2) | 0.19 |
| Solvent Solv-(1) | |
| Second Layer: Anti-Color-Mixing Layer | |
| Gelatin | 0.99 |
| Anti-Color-Mixing Agent Cpd-(3) | |
| Third Layer: Green-Sensitive Layer | |
| Monodisperse Silver Chlorobromide Emulsion | 0.12 |

-continued

| | |
|---|---|
| EM9 which had been spectrally sensitized with Sensitizing Dyes ExS-(2), ExS-(3) | |
| Monodisperse Silver Chlorobromide Emulsion EM10 which had been spectrally sensitized with Sensitizing Dyes ExS-(2), ExS-(3) | 0.24 |
| Gelatin | 1.24 |
| Magenta Coupler ExM-(1) | 0.39 |
| Colored Image Stabilizer Cpd-(4) | 0.25 |
| Colored Image Stabilizer Cpd-(5) | 0.12 |
| Solvent Solv-(2) | |
| Fourth Layer: Ultraviolet Absorbing Layer | |
| Gelatin | 1.60 |
| Ultraviolet Absorber (Cpd-(6)/Cpd-(7)/Cpd-(8) = 3/2/6 by weight) | 0.70 |
| Anti-Color-Mixing Agent Cpd-(9) | 0.05 |
| Solvent Solv-(3) | 0.42 |
| Fifth Layer: Red-Sensitive Layer | |
| Monodisperse Silver Chlorobromide Emulsion EM11 which had been spectrally sensitized with Sensitizing Dyes ExS-(4), ExS-(5) | 0.07 |
| Monodisperse Silver Chlorobromide Emulsion EM12 which had been spectrally sensitized with Sensitizing Dyes ExS-(4), ExS-(5) | 0.16 |
| Gelatin | 0.92 |
| Cyan Coupler ExC-(1) | 1.46 |
| Cyan Coupler ExC-(2) | 1.84 |
| Colored Image Stabilizer Cpd-(7)/Cpd-(8)/Cpd-(10) = 3/4/2 by weight) | 0.17 |
| Polymer for dispersion purposes Cpd-(11) | 0.14 |
| Solvent Solv-(1) | 0.20 |
| Sixth Layer: Ultraviolet Absorbing Layer | |
| Gelatin | 0.54 |
| Ultraviolet Absorber (Cpd-(6)/Cpd-(8)/Cpd-(10) = 1/5/3 by weight) | 0.21 |
| Solvent Solv-(4) | 0.08 |

-continued

| | |
|---|---|
| Seventh Layer: Protective Layer | |
| Gelatin | 1.33 |
| Acrylic modified poly(vinyl alcohol) copolymer (degree of modification: 17%) | 0.17 |
| Liquid paraffin | 0.03 |

Furthermore, Cpd-(12), Cpd-(13) were used as antiirradiation dyes.

Moreover, "aAlkanol XC" (Du Pont Co.), sodium alkylbenzenesulfonate, succinic acid ester and "Magefacx F-120" (Dainippon Ink Co.) were used in each layer as emulsification and dispersing agents and coating promotors. Cpd-(14), Cpd-(15) were also used as silver halide stabilizers.

Details of the emulsions used are indicated below.

| Emulsion | Form | Grain Size (μm) | Br Content (mol %) | Variation Coefficient* |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

*This represents the grain distribution of the grains $$\text{Variation Coefficient} = \frac{\text{Standard Diviation}}{\text{Average Size}}$$

The structural formulae of the compounds used are indicated below.

Same as ExY-2 in example 2. ExY-(1)

ExM-(1)

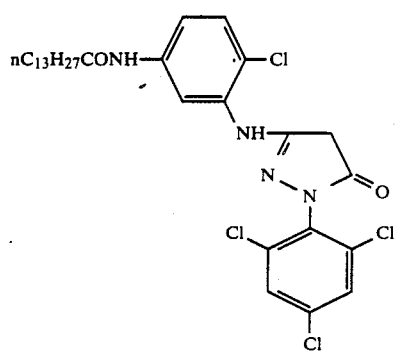

ExC-(1)

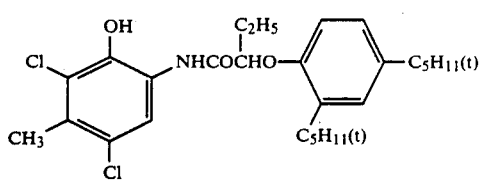

ExC-(2)

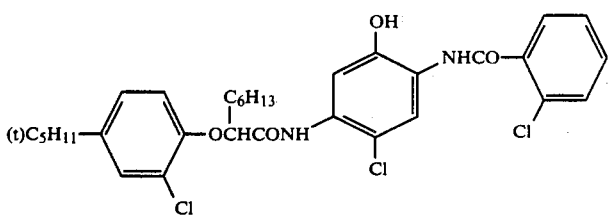

-continued

ExS-(1)

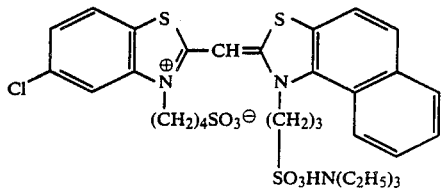

Same as ExS-3 in example 2 — ExS-(2)

ExS-3

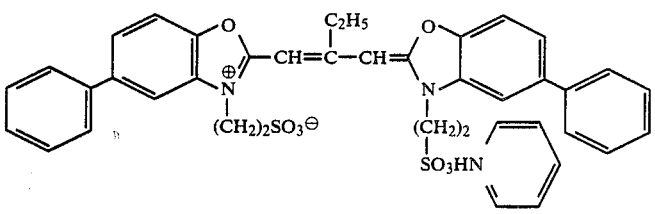

| | |
|---|---|
| Same as ExS-4 in example 2 | ExS-(4) |
| Same as ExS-5 in example 2 | ExS-(5) |
| Same as Cpd-2 in example 2 | Cpd-(1) |
| Same as Cpd-1 in example 2 | Cpd-(2) |
| Same as Cpd-3 in example 2 | Cpd-(3) |
| Same as Cpd-4 in example 2 | Cpd-(4) |

Cpd-(5)

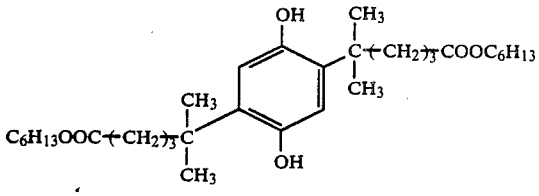

| | |
|---|---|
| Same as Cpd-7 in example 2 | Cpd-(6) |
| Same as Cpd-8 in example 2 | Cpd-(7) |
| Same as Cpd-9 in example 2 | Cpd-(8) |
| Same as Cpd-10 in example 2 | Cpd-(9) |
| Same as Cpd-12 in example 2 | Cpd-(10) |
| Same as Cpd-11 in example 2 | Cpd-(11) |

Cpd-(12)

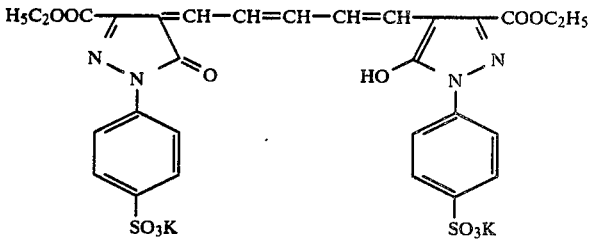

Cpd-(13)

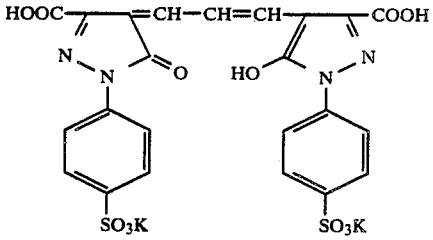

| | |
|---|---|
| Same as Cpd-15 in example 2 | Cpd-(14) |
| Same as Cpd-16 in example 2 | Cpd-(15) |
| Dibutyl phthalate | Solv-(1) |
| Trioctyl phosphate | Solv-(2) |
| Trinonyl phosphate | Solv-(3) |
| Tricresyl phosphate | Solv-(4) |

All the gelatin used as alkali-treated gelatin of isoelectric point 5.0. This material was Sample 2-A.

manner as in Example 2 and the results obtained were as shown in Table 3.

TABLE 3

| No. | Color Developer Additives: Compound D (0.04 mol/l) | Compound D (0.03 mol/l) | Sodium Sulfite (mol/l) | Remarks | Photographic Characteristics: Fresh Solution $D_{min}$ | Fresh Solution Gradation | Aged Solution $D_{min}$ | Aged Solution Gradation |
|---|---|---|---|---|---|---|---|---|
| 3-1 | VII-1 | N,N-Diethylhydroxylamine | $1.5 \times 10^{-2}$ | Comparison | 0.10 | 0.48 | 0.16 | 0.72 |
| 3-2 | " | " | $0.5 \times 10^{-2}$ | " | 0.10 | 0.61 | 0.17 | 0.76 |
| 3-3 | " | " | — | " | 0.10 | 0.80 | 0.17 | 0.90 |
| 3-4 | " | N,N-Dimethylhydrazine | — | " | 0.10 | 0.77 | 0.13 | 0.83 |
| 3-5 | " | I-5 | — | Invention | 0.10 | 0.80 | 0.10 | 0.81 |
| 3-6 | VIII-1 | " | — | " | 0.10 | 0.80 | 0.11 | 0.82 |
| 3-7 | VIII-6 | " | — | " | 0.10 | 0.80 | 0.11 | 0.82 |
| 3-8 | IX-1 | " | — | " | 0.10 | 0.80 | 0.11 | 0.82 |
| 3-9 | IX-8 | " | — | " | 0.10 | 0.79 | 0.12 | 0.82 |
| 3-10 | X-4 | " | — | " | 0.10 | 0.79 | 0.12 | 0.83 |
| 3-11 | XI-3 | " | — | " | 0.10 | 0.80 | 0.11 | 0.82 |
| 3-12 | XII-1 | " | — | " | 0.01 | 0.80 | 0.11 | 0.82 |
| 3-13 | XVI-1 | " | — | " | 0.01 | 0.80 | 0.10 | 0.81 |
| 3-14 | XVII-7 | " | — | " | 0.10 | 0.80 | 0.10 | 0.81 |
| 3-15 | VII-1 | I-6 | — | " | 0.10 | 0.80 | 0.10 | 0.81 |
| 3-16 | VIII-1 | " | — | " | 0.10 | 0.80 | 0.12 | 0.83 |
| 3-17 | XVI-1 | " | — | " | 0.10 | 0.80 | 0.11 | 0.81 |
| 3-18 | XVI-7 | " | — | " | 0.10 | 0.80 | 0.11 | 0.81 |

| Processing Step | Temperature (°C.) | Time (sec.) |
|---|---|---|
| Color Development | 35 | 45 |
| Bleach-Fixing | 35 | 45 |
| Stabilizing (1)* | 35 | 30 |
| Stabilizing (2) | 35 | 30 |
| Stabilizing (3) | 35 | 30 |
| Drying | 70–80 | 60 |

*Stabilizing was carried out using three tank countercurrent washing from stabilizing (3) to stabilizing (1). The processing solutions used were as indicated below.

| | |
|---|---|
| Color Development Solution: | |
| Compound C (compound used in combination) | See Table 3 |
| Compound D (compound of the present invention) | See Table 3 |
| Sodium Sulfite | See Table 3 |
| Potassium Carbonate | 30 g |
| Ethylenediamine-N,N,N',N'-tetra methylenephosphonic Acid | 3.1 g |
| Sodium Chloride | 1.5 g |
| Color Developing Agent (same as in Example 2) | 0.01 mol |
| Brightening Agent (UVITEX-CK, 4,4'-diaminostilbene series brightening agent, manufactured by Ciba Geigy Co.) | 3.0 g |
| Water to make | 1,000 ml |
| pH | 10.25 |
| Bleach-Fixing Solution: | |
| EDTA.Fe(III)$NH_4$.2$H_2O$ | 60 g |
| EDTA.2Na.2$H_2O$ | 4 g |
| Ammonium Thiosulfate (700 g/liter) | 120 ml |
| Sodium Sulfite | 16 g |
| Ammonium Bromide | 30 g |
| Glacial Acetic Acid | 7 g |
| Water to make | 1,000 ml |
| pH (25° C.) | 5.5 |
| Stabilizer Solution: | |
| Formalin (37 wt %) | 0.1 ml |
| 1-Hydroxyethylidene-1,1-diphosphonic Acid (60 wt %) | 1.6 ml |
| Bismuth Chloride | 0.35 g |
| Aqueous Ammonia (26 wt %) | 2.5 ml |
| Nitrilotriacetic Acid.Trisodium Salt | 1.0 g |
| EDTA.4H | 0.5 g |
| 5-Chloro-2-methyl-4-isothiazolin-3-one | 50 mg |
| Water to make | 1,000 ml |

The changes in photographic characteristics with fresh and aged solutions were obtained in the same In the present invention, the change in the photographic characteristics due to aging of the processing solution is slight.

EXAMPLE 6

Good photographic characteristics were obtained with the present invention upon processing in the same manner as in Example 5, except that the stabilizer solutions were replaced with ion exchanged water of which the calcium and magnesium contents were 3 ppm or less.

EXAMPLE 7

A printing paper was prepared by coating the first layer (bottom layer) to seventh Layer (top layer), indicated below, sequentially onto a paper which had been laminated on both sides with polyethylene and which had been subjected to a corona discharge treatment. The coating solution were prepared in the manner indicated below. Moreover, the structural formulae and details of the couplers and colored image stabilizers, etc., used in the coating solutions are described hereinafter.

The coating solution for the first layer was prepared in the following way. Thus, 60 ml of ethyl acetate was added as an auxiliary solvent to 200 g of yellow coupler, 93.3 g of anti-color-fading agent, 10 g of High Boiling Point Organic Solvent (p) and 5 g of Solvent (q) and the mixture was heated to 60° C. to form a solution, after which the solution was mixed with 3,300 ml of a 5 wt% aqueous gelatin solution which contained 330 ml of a 5 wt% aqueous solution of "Alkanol B" (trade name, alkylnaphthalenesulfonate, made by Du Pont). A coupler dispersion was then prepared by dispersing this solution in a colloid mill. The ethyl acetate was removed from the resulting dispersion under reduced pressure. Then, 1,400 g of an emulsion (containing 96.7 g as silver and 170 g of gelatin), to which the sensitizing dye for the blue-sensitive emulsion and 1-methyl-2-mercapto-5-acetylamino-1,3,4-triazole had been added, was added and the coating solution was obtained by further adding 2,600 g of a 10 wt% aqueous solution of gelatin to this mixture. The coating solutions for second to seventh layers were prepared in the same manner as that for first layer according to the compositions shown below.

| | |
|---|---|
| Seventh Layer: Protective Layer | 600 mg/m$^2$ |
| Gelatin | |
| Sixth Layer: Ultraviolet Absorbing Layer | |
| Ultraviolet Absorber (n) | 260 mg/m$^2$ |
| Ultraviolet Absorber (o) | 70 mg/m$^2$ |
| Solvent (p) | 300 mg/m$^2$ |
| Solvent (q) | 100 mg/m$^2$ |
| Gelatin | 700 mg/m$^2$ |
| Fifth Layer: Red-Sensitive Layer | |
| Silver Chlorobromide Emulsion (70 mol % AgBr) | 210 mg/m$^2$ |
| Cyan Coupler (see TABLE 4) | $5 \times 10^{-4}$ mol/m$^2$ |
| Anti-Color-Mixing Agent (r) | 250 mg/m$^2$ |
| Solvent (p) | 160 mg/m$^2$ |
| Solvent (q) | 100 mg/m$^2$ |
| Gelatin | 1,800 mg/m$^2$ |
| Fourth Layer: Anti-Color-Mixing Layer | |
| Anti-Color-Mixing Agent (s) | 65 mg/m$^2$ |
| Ultraviolet Absorber (n) | 450 mg/m$^2$ |
| Ultraviolet Absorber (o | 230 mg/m$^2$ |
| Solvent (p) | 50 mg/m$^2$ |
| Solvent (q) | 50 mg/m$^2$ |
| Gelatin | 1,700 mg/m$^2$ |
| Third Layer: Green-Sensitive Layer | |
| Silver Chlorobromide Emulsion (70 mol % AgBr) | 65 mg/m$^2$ |
| Magenta Coupler | 670 mg/m$^2$ |
| Anti-Color-Mixing Agent (t) | 150 mg/m$^2$ |
| Anti-Color-Mixing Agent (u) | 10 mg/m$^2$ |
| Solvent (p) | 200 mg/m$^2$ |
| Solvent (q) | 10 mg/m$^2$ |
| Gelatin | 1,400 mg/m$^2$ |
| Second Layer: Anti-Color-Mixing Layer | |
| Silver Bromide Emulsion (primitive emulsion, grain size: 0.05 μm) | 10 mg/m$^2$ |
| Anti-Color-Mixing Agent (s) | 55 mg/m$^2$ |
| Solvent (p) | 30 mg/m$^2$ |
| Solvent (q) | 15 mg/m$^2$ |
| Gelatin | 800 mg/m$^2$ |
| First Layer: Blue-Sensitive Layer | |
| Silver Chlorobromide Emulsion (80 mol % AgBr) | 290 mg/m$^2$ |
| Yellow Coupler | 600 mg/m$^2$ |
| Anti-Color-Mixing Agent (r) | 280 mg/m$^2$ |
| Solvent (p) | 30 mg/m$^2$ |
| Solvent (q) | 15 mg/m$^2$ |

-continued

| | |
|---|---|
| Gelatin | 1,800 mg/m$^2$ |

Support

Paper support laminated with polyethylene on both sides n: 2-(2-Hydroxy-3,5-di-tert-amylphenyl)benzotriazole o: 2-(2-Hydroxy-3,5-di-tert-butylphenyl)benzotriazole p: Di(2-ethylhexyl)phthalate q: Dibutyl phthalate r: 2,5-Di-tert-amylphenyl-3,5-di-tert-butylhydroxybenzoate s: 2,5-Di-tert-octylhydroquLnone t: 1,4-Di-tert-amyl-2,5-dioctyloxybenzene u: 2,2,-Methylenebis(4-methyl-6-tert-butyl-phenol)

The substances indicated below were used as sensitizing dyes for each of the emulsion layers.

Blue-Sensitive Emulsion Layer

Anhydro-5-methyl-5'-methyl-3,3'-disulfopropylselenacyanine hydroxide

Green-Sensitive Emulsion Layer

Anhydro-9-ethyl-5,5'-diphenyl-3,3'-disulfoethyloxacarbocyanine hydroxide

Red-Sensitive Emulsion Layer 3,3'-Diethyl-5-methoxy-9,9'-(2,2-dimethyl-1,3-propano)thiadicarbocyanine iodide The following substance was used in each emulsion layer as a stabilizer: 1-Methyl-2-mercapto-5-acetylamino-1,3,4-triazole.

Furthermore, the substances indicated below were used as antiirradiation dyes.

Dicalcium 4-[3-carboxy-5-hydroxy-4-{3-[carboxy-5-oxo-1-(4-sulfonatophenyl) -2-pyrazolin-4-indene]-1-propenyl)-1-pyrazolyl]benzenesulfonate Tetrasodium N,N'-(4,8-dihydroxy-9,10-dioxo-3,7-disulfonatoanthracene-1,5-diyl) bis(aminomethanesulfonate)

Furthermore, 1,2-bis(vinylsulfonyl)ethane was used as a film hardening agent.

The couplers used were as follows:

Yellow Coupler

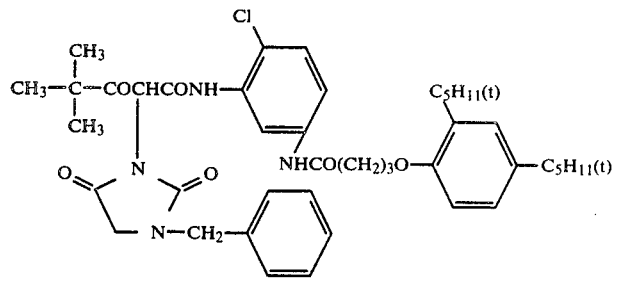

Magenta Coupler

-continued

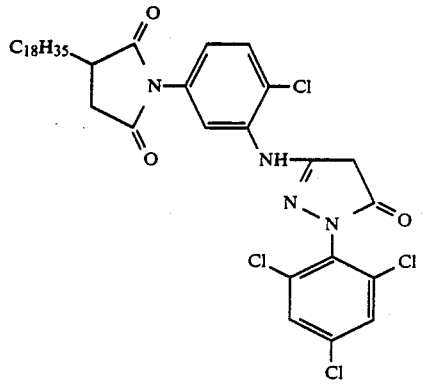

Cyan Coupler

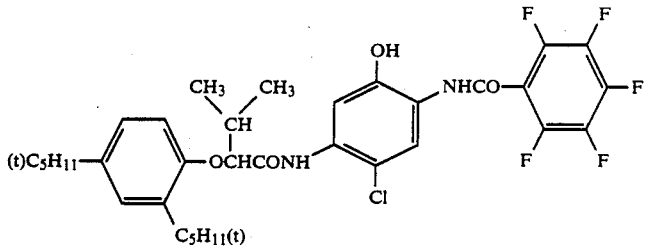

and

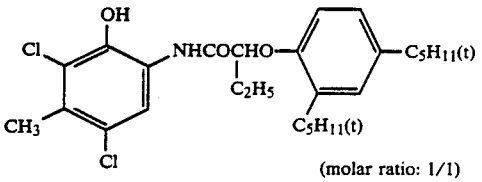

(molar ratio: 1/1)

After imagewise exposure, the multilayer color printing paper obtained, as indicated above, was processed continuously under the following processing conditions.

| Processing Step | Temperature (°C.) | Time | Replenishment Rate (ml/M²) |
|---|---|---|---|
| Color Development | 38 | 3 min 30 sec | 160 |
| Bleach Fixing | 30 | 1 min 30 sec | 100 |
| Rinse (1) | 30 | 40 sec | — |
| Rinse (2) | 30 | 40 sec | — |
| Rinse (3) | 30 | 40 sec | 200 |
| Drying | 60–70 | 50 sec | — |

Rinsing was carried out using a three-tank countercurrent system from rinse (3) to rinse (1).

| Color Development Solution | Tank Solution | Replenisher |
|---|---|---|
| Compound E (see TABLE 4) | 0.03 mol | 0.04 mol |
| Compound F (see TABLE 4) | 0.03 mol | 0.04 mol |
| Brightening Agent (4,4'-diaminostilbene based "WHITEX 4, manufactured by Sumitomo Chemical Co., Ltd.) | 3.0 g | 4.0 g |
| Ethylenediamine-N,N,N',N',-tetramethylenephosphonic Acid | 1.0 g | 1.5 g |
| Potassium Carbonate | 30.0 g | 30.0 g |
| Potassium Bromide | 1.4 g | |
| 4-Amino-3-methyl-N-ethyl-N-β-(methanesulfonamido)ethylaniline Sulfate | 5.0 g | 7.0 g |
| Benzyl Alcohol (see TABLE 4) | 300 ml | 300 ml |
| 1,2-Dihydroxybenzene-3,4,6-trisulfonic Acid | 1,000 ml | 1,000 ml |
| Water to make | 10.10 | 10.50 |
| pH | | |
| **Bleach-Fixing Solution (tank solution and replenisher were both the same)** | | |
| EDTA.Fe(III)$NH_4$.2$H_2O$ | 60 g | |
| EDTA.2Na.2$H_2O$ | 4 g | |
| Ammonium Thiosulfate (700 g/liter) | 120 ml | |
| Sodium Sulfite | 16 g | |
| Glacial Acetic Acid | 7 g | |
| Water to make | 1,000 ml | |
| pH (25° C.) | 5.5 | |
| **Rinsing Solution (tank solution and replenisher were both the same)** | | |
| 5-Chloro-2-methyl-4-isothiazolin-3-one | 40 g | |
| 2-Methyl-4-isothiazolin-3-one | 10 g | |
| 2-Octyl-4-isothiazolin-3-one | 10 mg | |
| Bismuth Chloride | 0.5 g | |
| Nitrilo-N,N,N-trimethylenephosphonic Acid (40 wt %) | 1.0 g | |
| 1-Hydroxyethylidene-1,1-diphosphonic Acid (60 wt %) | 2.5 g | |
| Brightening Agent (UVITEX-CK, 4,4'-diaminostilbene series brightening agent, manufactured by Ciba Geigy Co.) | 1.0 g | |
| Aqueous Ammonia (26 wt %) | 2.0 ml | |
| Water to make | 1,000 ml | |
| pH adjusted to 7.5 with KOH | | |

TABLE 4

| No. | Color Developer Additives: Compound E | Compound F | Benzyl Alcohol (tank solution and replenisher) (ml/l) | Remarks | Change in Photographic Characteristics: $\Delta D_{min}$ | $\Delta$Gradation | $\Delta D_{min}$ after Aging |
|---|---|---|---|---|---|---|---|
| 4-1 | Hydroxylamine Sulfate | VIII-1 | 15/20 | Comparison | +0.05 | +0.11 | +0.26 |
| 4-2 | Hydroxylamine Sulfate | " | — | " | +0.03 | +0.11 | +0.23 |
| 4-3 | Hydroxylamine Sulfate | XVI-7 | — | " | +0.03 | +0.11 | +0.22 |
| 4-4 | I-5 | VII-1 | — | Invention | 0 | +0.01 | +0.12 |
| 4-5 | " | XVI-7 | — | " | 0 | +0.01 | +0.11 |
| 4-6 | " | " | 15/20 | " | +0.01 | +0.03 | +0.15 |
| 4-7 | I-6 | VII-1 | — | " | 0 | +0.01 | +0.11 |
| 4-8 | " | XVI-7 | — | " | +0.01 | +0.01 | +0.11 |
| 4-9 | " | " | 15/20 | " | +0.02 | +0.03 | +0.15 |
| 4-10 | " | " | 5/8 | " | +0.01 | +0.02 | +0.14 |
| 4-11 | " | XVI-1 | — | " | 0 | +0.01 | +0.11 |

Continuous processing (i.e., running tests) was carried out under various conditions until the color development solution had been replenished to the extent of three times the development tank capacity (20 liters). The values of $D_{min}$ and the change in yellow color-forming density (B density) in the gradation part at the beginning and end of the processing run were measured using a Fuji-type automatic densitometer. Moreover, a sample obtained at the end of the running test was left to stand for 1 month at 80° C. (humidity: 5 to 10% (RH]) and the changes in the $D_{min}$ density in the $D_{min}$ part were measured subsequently.

The results obtained with respect to the changes in photographic characteristics were as shown in Table 4.

The change in photographic characteristics which accompanies running is reduced and the increase in yellow staining due to aging after processing is also reduced when the present invention is used.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having thereon at least one light-sensitive silver halide emulsion layer wherein, after imagewise-exposure, said method comprises processing said silver halide color photographic material with a color developer containing (1) at least one aromatic primary amine developing agent and (2) at least one compound capable of releasing an aromatic primary amine developing agent which is represented by formula (I):

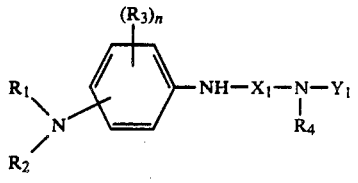

(I)

wherein $R_1$ and $R_2$ each represents a hydrogen atom or an alkyl group, $R_3$ represents a group that can be substituted, $R_4$ represents a hydrogen atom, an alkyl group or an aryl group, $X_1$ represents a divalent group selected from the group consisting of —CO—, $SO_2$—, —SO—,

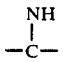

and —COCO—, and $Y_1$ represents an

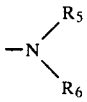

group or an —$OR_7$ group, wherein $R_5$ and $R_6$ each represents a hydrogen atom, an alkyl group or an aryl group and $R_7$ represents a hydrogen atom or a group which can be hydrolyzed to become a hydrogen atom, provided that $R_1$ and $R_2$, or $R_1$ and the benzene ring, or $R_2$ and the benzene ring, may be joined together to form a ring; and n has a value of 0, 1, 2, 3 or 4, wherein said compound represented by formula (I) has substantially no developing agent ability prior to the release of the aromatic primary amine developing agent.

2. The method for processing a silver halide color photographic material as in claim 1, wherein $R_1$ and $R_2$ each is a substituted or unsubstituted alkyl group; $R_3$ is an alkyl group, an alkoxy group, a halogen atom, or an alkylthio group; $R_4$ is a hydrogen atom; $X_1$ is a —CO— group or a —COCO— group; and $Y_1$ is an $NHR_5$ group or an —OH group.

3. The method for processing a silver halide color photographic material as in claim 1, wherein said compound represented by formula (I) is represented by formula (II):

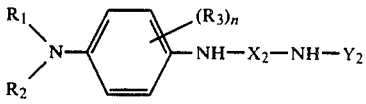

(II)

wherein $R_1$, $R_2$ and $R_3$ and n have the same meaning as in formula (I); $X_2$ represents a divalent group selected from the group consisting of a —CO— group and a —COCO— group, and $Y_2$ represents an —$NHR_5$ group or an —OH group, wherein $R_5$ has the same meaning as in formula (I).

4. The method for processing a silver halide color photographic material as in claim 1, wherein said compound represented by formula (I) is present in said developer in an amount of from 0.01 to 20 g per liter of said color developer.

5. The method for processing a silver halide color photographic material as in claim 1, wherein said color developer is a p-phenylenediamine compound.

6. The method for processing a silver halide color photographic material as in claim 1, wherein said aromatic primary amine developing agent is present in an amount of from 0.1 to 20 g per liter of the developer.

7. The method for processing a silver halide color photographic material as in claim 1, wherein said color developer contains benzyl alcohol in an amount of 2 ml or less per liter of the developer.

8. The method for processing a silver halide color photographic material as in claim 1, wherein said color developer does not contain benzyl alcohol at all.

9. The method for processing a silver halide color photographic material as in claim 1, wherein said color developer further contains a compound represented by formula (VII) or formula (XVI):

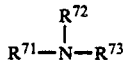

(VII)

wherein $R^{71}$, $R^{72}$ and $R^{73}$ each represents a hydrogen atom, an alkyl group, an alkenyl group, an aryl group, an aralkyl group, or a heterocyclic group, $R^{71}$ and $R^{72}$, $R^{71}$ and $R^{73}$, or $R^{72}$ and $R^{73}$ may combine with each other to form a nitrogen-containing heterocyclic ring, and the groups represented by $R^{71}$, $R^{72}$ and $R^{73}$ may be substituted;

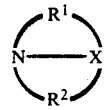

(XVI)

wherein X represents a trivalent atomic group necessary for completing a condensed ring, and $R^1$ and $R^2$ each represents an alkylene group, an arylene group, an alkenylene group or an aralkylene group, and $R^1$ and $R^2$ may be the same or different.

10. The method for processing an image-exposed silver halide color photographic material as in claim 1, wherein said group for $R_7$ which can be hydrolyzed to become a hydrogen atom is

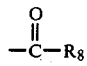

wherein $R_8$ represents a substituted or unsubstituted alkyl group or a substituted or unsubstituted amino group,

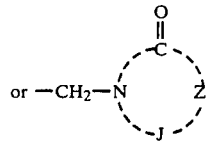

wherein J represents

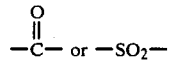

and Z represents a plurality of atoms which is required to complete a heterocyclic ring which has at least one 5— or 6—membered ring.

11. The method for processing a silver halide color photographic material as in claim 3, wherein $R_5$ represents a hydrogen atom or a substituted or unsubstituted alkyl group.

12. The method for processing a silver halide color photographic material as in claim 3, wherein $R_5$ represents a hydrogen atom.

13. The method for processing a silver halide color photographic material as in claim 1, wherein n is 0 or 1.

* * * * *